US011766588B2

(12) United States Patent
Smith et al.

(10) Patent No.: US 11,766,588 B2
(45) Date of Patent: Sep. 26, 2023

(54) ROWING SYSTEM AND METHOD

(71) Applicant: Hydrow, Inc., Cambridge, MA (US)

(72) Inventors: Bruce Smith, Cambridge, MA (US); Chris Paul, Lincoln, MA (US); Christopher Evans, Amherst, NH (US); Gerhard Pawelka, Lexington, MA (US); William Burke, San Francisco, CA (US); Harald Quintus-Bosz, Sudbury, MA (US); Klaus Renner, Hollis, NH (US)

(73) Assignee: Hydrow, Inc., Cambridge, MA (US)

( * ) Notice: Subject to any disclaimer, the term of this patent is extended or adjusted under 35 U.S.C. 154(b) by 0 days.

(21) Appl. No.: 17/470,846

(22) Filed: Sep. 9, 2021

(65) Prior Publication Data

US 2021/0402250 A1 Dec. 30, 2021

Related U.S. Application Data

(63) Continuation of application No. 16/588,385, filed on Sep. 30, 2019, now Pat. No. 11,130,017, which is a (Continued)

(51) Int. Cl.

| | |
|---|---|
| ***A63B 22/00*** | (2006.01) |
| ***A63B 21/005*** | (2006.01) |
| ***A63B 24/00*** | (2006.01) |

(52) U.S. Cl.

CPC ..... *A63B 22/0076* (2013.01); *A63B 21/0051* (2013.01); *A63B 21/0057* (2013.01); (Continued)

(58) Field of Classification Search

CPC ..... A63B 22/0076; A63B 21/0051; A63B 22/0087; A63B 24/0087; A63B 21/0057; (Continued)

(56) References Cited

U.S. PATENT DOCUMENTS 2,002 A * 3/1841 Rider ..... A01C 5/06 111/81

4,735,410 A 4/1988 Nobuta (Continued)

FOREIGN PATENT DOCUMENTS

| | | |
|---|---|---|
| CN | 1484538 | 3/2004 |
| CN | 101234224 | 8/2008 |

(Continued)

OTHER PUBLICATIONS

Chinese Office Action in CN Appln. No. 201980047722.3, dated Oct. 20, 2021, 18 pages with English Translation.

(Continued)

*Primary Examiner* — Garrett K Atkinson
(74) *Attorney, Agent, or Firm* — Fish & Richardson P.C.

(57) ABSTRACT

Among other things, a rowing technology includes a first rowing machine having an electromagnetic brake providing a resistance to a rower of the machine in each rowing stroke of a series of rowing strokes of the rower An electronic controller causes the resistance of the electromagnetic brake to vary over each rowing stroke in a profile that emulates resistance to which another rower in a shell on water or on a second rowing machine is subjected in each rowing stroke of a corresponding series of rowing strokes.

23 Claims, 21 Drawing Sheets

Related U.S. Application Data continuation of application No. 15/981,834, filed on May 16, 2018, now Pat. No. 10,471,297.

(52) U.S. Cl.
CPC ..... *A63B 22/0087* (2013.01); *A63B 24/0087* (2013.01); *A63B 2022/0079* (2013.01)

(58) Field of Classification Search
CPC ..... A63B 2022/0079; A63B 24/0084; A63B 2220/51; A63B 2071/0655; A63B 2220/805; A63B 2209/08; A63B 2230/01; A63B 2071/0638; A63B 2220/833; A63B 2220/16; A63B 2220/806; A63B 2220/34; A63B 2225/09; A63B 2220/89; A63B 2220/808; A63B 2071/0625; A63B 2230/06; A63B 2071/0694; A63B 2210/50; A63B 2230/75; A63B 24/0075; A63B 2024/009; A63B 2220/10; A63B 2220/40; A63B 2220/72; A63B 2225/66; A63B 2220/80; A63B 2220/30; A63B 2225/50; A63B 2220/54; A63B 2220/20; A63B 2220/62; A63B 2071/063; A63B 2024/0081
See application file for complete search history.

(56) References Cited

U.S. PATENT DOCUMENTS 4,798,378 A 1/1989 Jones
4,984,986 A 1/1991 Vohnout
5,076,573 A 12/1991 Lo
5,409,435 A 4/1995 Daniels
5,466,200 A * 11/1995 Ulrich ..... A63F 13/285 482/3
5,656,001 A * 8/1997 Baatz ..... A63B 21/0052 482/61
5,772,560 A 6/1998 Watterson et al.
6,447,424 B1 9/2002 Ashby et al.
6,601,016 B1 7/2003 Brown et al.
6,626,799 B2 9/2003 Watterson et al.
6,701,271 B2 3/2004 Willner et al.
6,749,537 B1 6/2004 Hickman
6,808,472 B1 10/2004 Hickman
6,902,513 B1 * 6/2005 McClure ..... A63B 24/0006 482/4
6,921,351 B1 7/2005 Hickman et al.
6,945,917 B1 * 9/2005 Baatz ..... A63B 21/0051 482/57
7,166,064 B2 1/2007 Watterson et al.
7,311,640 B2 * 12/2007 Baatz ..... A63B 24/00 482/4
7,556,590 B2 7/2009 Watterson et al.
7,628,730 B1 12/2009 Watterson et al.
7,769,794 B2 8/2010 Moore et al.
7,874,957 B2 1/2011 Hurwitz et al.
7,946,961 B2 5/2011 Blum et al.
8,103,517 B2 1/2012 Hinnebusch
8,152,696 B2 4/2012 Blum et al.
8,409,057 B2 4/2013 Martens
8,622,876 B2 * 1/2014 Kelliher ..... A63B 22/0087 482/73
8,684,888 B2 4/2014 Blum et al.
9,174,085 B2 * 11/2015 Foley ..... A63B 24/0075
9,233,276 B1 * 1/2016 Foley ..... A63B 24/0062
9,302,152 B2 4/2016 Blum et al.
9,861,855 B2 * 1/2018 Foley ..... A63B 21/015
9,974,995 B2 5/2018 Hall
10,322,315 B2 6/2019 Foley et al.
10,471,297 B1 11/2019 Smith et al.
10,486,026 B2 11/2019 Foley et al.
10,610,725 B2 * 4/2020 Schaefer ..... G16H 20/30
10,639,521 B2 5/2020 Foley et al.
10,828,531 B1 * 11/2020 Smith ..... A63B 22/0087
10,946,263 B2 * 3/2021 Felker ..... A63B 71/0622
10,956,630 B2 * 3/2021 Le Chevalier ..... A63B 21/0552
11,130,017 B2 * 9/2021 Smith ..... A63B 24/0084
11,229,825 B1 1/2022 Wachirajindakul et al.
2005/0164833 A1 7/2005 Florio
2007/0219059 A1 9/2007 Schwartz et al.
2008/0005276 A1 1/2008 Frederick
2008/0052756 A1 2/2008 Morishige et al.
2008/0280736 A1 * 11/2008 D'Eredita ..... A63B 69/06 482/72
2009/0075782 A1 3/2009 Joubert et al.
2009/0164448 A1 6/2009 Curtis
2009/0233769 A1 9/2009 Pryor
2009/0291726 A1 * 11/2009 Svensson ..... G01S 5/0072 463/7
2009/0291805 A1 11/2009 Blum et al.
2010/0144497 A1 6/2010 Clark
2010/0173749 A1 * 7/2010 Lannon ..... A63B 24/0062 482/8
2010/0248906 A1 9/2010 D'Eredita et al.
2011/0082009 A1 * 4/2011 Ranky ..... A63B 71/0622 482/8
2011/0105281 A1 5/2011 Jerichow
2011/0201477 A1 8/2011 Blum et al.
2011/0245044 A1 * 10/2011 Kelliher ..... A63B 21/4035 482/72
2012/0120771 A1 * 5/2012 Lapides ..... A63B 71/0686 368/10
2012/0237910 A1 9/2012 Blum et al.
2013/0130206 A1 5/2013 Smith et al.
2013/0274635 A1 * 10/2013 Coza ..... G16H 40/63 600/595
2014/0172135 A1 * 6/2014 Eisner ..... A63B 71/0616 700/91
2014/0244010 A1 * 8/2014 Harvey ..... A63K 3/00 700/91
2014/0337450 A1 * 11/2014 Choudhary ..... G06F 40/186 709/206
2015/0057130 A1 2/2015 Lin et al.
2015/0360083 A1 * 12/2015 Lagree ..... A63B 24/0087 482/130
2016/0287939 A1 10/2016 Deochand et al.
2017/0319889 A1 11/2017 Cei et al.
2017/0319904 A1 11/2017 Deochand et al.
2017/0319906 A1 * 11/2017 Chang ..... A63B 24/0087
2018/0056132 A1 * 3/2018 Foley ..... G16H 20/30
2018/0099178 A1 * 4/2018 Schaefer ..... A63B 24/0075
2018/0126249 A1 * 5/2018 Consiglio ..... A63B 22/0023
2018/0140903 A1 5/2018 Poure et al.
2018/0161658 A1 * 6/2018 Felker ..... A63B 24/0062
2018/0214729 A1 8/2018 Rubin et al.
2018/0264366 A1 * 9/2018 Kawahara ..... A63F 13/798
2018/0285496 A1 * 10/2018 Le Chevalier ..... G06F 30/20
2018/0339195 A1 * 11/2018 Bernotas ..... A63B 22/0076
2019/0070448 A1 * 3/2019 Jeremie ..... A63B 21/0059
2019/0126099 A1 5/2019 Hoang
2019/0255386 A1 8/2019 Trotter
2019/0290964 A1 9/2019 Oren
2019/0336827 A1 11/2019 Intonato et al.
2019/0351283 A1 11/2019 Smith et al.
2020/0078635 A1 3/2020 Smith et al.
2020/0376328 A1 12/2020 Smith et al.
2021/0060378 A1 * 3/2021 Smith ..... A63B 24/0087
2022/0143465 A1 5/2022 Wachirajindakul et al.

FOREIGN PATENT DOCUMENTS

CN 202179824 4/2012
CN 204219688 3/2015
CN 205699387 11/2016
CN 107970562 5/2018
CN 110327587 10/2019
EP 0919259 6/1999
RU 2630436 9/2017
TW M554814 2/2018
WO WO9606664 3/1996

(56) References Cited

FOREIGN PATENT DOCUMENTS

| | | |
|---|---|---|
| WO | WO2005087323 | 9/2005 |
| WO | WO2017008775 | 1/2017 |
| WO | WO2017009775 | 1/2017 |
| WO | WO2019023473 | 1/2019 |

OTHER PUBLICATIONS

European Search Report in EP Appln. No. 19803716, dated Jan. 26, 2022, 12 pages.
PCT International Search Report and Written Opinion in International Appln. No. PCT/US2021/047249, dated Sep. 20, 2021, 10 pages.
Support.hydrow.com [online], "How the Leaderboard Works", published on Jul. 30, 2019, retrieved on Sep. 13, 2021, retrieved from URL<https://support.hydrow.corn/hc/en-us/articles/360031429651-How-the-Leaderboard-Works>.
'www.commonwealthmagazine.org' [online] "Bruce Smith wants to take rowing to a new level," Apr. 2015 [retrieved May 9, 2018]. Retrieved from the Internet: URL <https://commonwealthmagazine.org/environment/bruce-smith-wants-to-take-rowing-to-a-new-level/>. 25 pages.
'www.concept2.com' [online]. "Concept 2—The world's leading rowing machine," Dec. 25, 1996 [retrieved on May 9, 2018]. Retrieved from the Internet: URL http://www.concept2.com/. 2 pages.
'www.liverowing.com' [online]. "Liverowing," Feb. 2, 2011 [retrieved on May 9, 2018]. Retrieved from URL <https://liverowing.com/>. 5 pages.
'www.onepeloton.com' [online]. "The Peloton Bike: Live studio cycling, ready when you are," Sep. 22, 2017 [retrieved on May 9, 2018]. Retrieved from the Internet: URL <https://www.onepeloton.com/>. 9 pages.
'www.rowlab.com' [online]. "Stream Live and On-Demand Rowing Classes," 2017 [Retrieved on May 9, 2018]. Retrieved from the Internet: URL < https://rowlab.co/>. 4 pages.
'www.truerowing.com' [online]. "CREW by True Rowing: Redefining indoor workouts," [retrieved on May 9, 2018]. Retrieved from the Internet: URL <http://www.truerowing.com/>. 5 pages.
Flywheelsports.com [online], "Take the class of your life, your first fly is free", Published on or before May 30, 2019, retrieved on Mar. 18, 2020, retrieved from URL<https://www.flywheelsports.com/> 5 pages.
Mogan et al., "To be in synchrony or not? A meta-analysis of synchrony's effects on behavior, perception cognition and affect," Journal of Experimental Social Psychology, 2017, 72: 13-20.
Office Action in U.S. Appl. No. 16/426,347, dated Aug. 5, 2019, 12 pages.
PCT International Preliminary Report on Patentability in International Appln. No. PCT/US2019/030646, dated Nov. 17, 2020, 10 pages.
PCT International Search Report and Written Opinion in International Application No. PCT/US2019/30646, dated Aug. 29, 2019, 18 pages.
PCT International Search Report and Written Opinion in International Appln. No. PCT/US2020/032132, dated Aug. 18, 2020, 15 pages.
ProForm.com [online], "Rowers", published on or before May 30, 2019, retrieved from URL<https://www.proform.com/rowing-machines/750r-rower> 15 pages.
Taiwanese Office Action in TW Appln. No. 109117615, dated Dec. 29, 2020, 19 pages with English Translation.
'www.concept2.com' [online]. "How To Use Your PM4," Aug. 28, 2012 [retrieved on Jun. 3, 2019]. Retrieved from the Internet: URL <https://www.concept2.com/service/monitors/pm4/how-to-use/viewing-drag-factor>. 2 pages.
'www.thestrokemaster.com' [online]. "The Stroke Master Elite Rowing Trainer," 2019 [retrieved on Jun. 10, 2019]. Retrieved from the Internet: https://thestroketnaster.com/products/. 6 pages.
Yogatoday.com [online], "Your Yogatoday Studio", published on or before May 30, 2019, retrieved on Mar. 18, 2020, retrieved from URL<https://www.yogatoday.com/>, 5 pages.
Chinese Office Action in CN Appln. No. 202080053324.5, dated Nov. 17, 2022, 10 pages (with English translation).
PCT International Preliminary Report on Patentability in International Appln. No. PCT/US2021/047249, dated Mar. 9, 2023, 9 pages.
Japanese Office Action in JP Appln. No. 2020-564448, dated May 9, 2023, 10 pages (with English Translation).

* cited by examiner

ROWING SYSTEM AND METHOD

CROSS-REFERENCE TO RELATED APPLICATION

This application is a continuation of U.S. application Ser. No. 16/588,385, filed on Sep. 30, 2019, which is a continuation of U.S. application Ser. No. 15/981,834, filed on May 16, 2018. The entire contents of the above applications are incorporated here by reference in their entirety.

BACKGROUND

This description relates to rowing.

Rowing is an excellent exercise that, with proper technique, uses most of the muscle groups in the rower's body and exercises more muscle groups intensively than nearly any other endurance activity.

Rowing is often a group activity for which rowers meet in a place and at a time to row in one shell or to race against each other using separate shells. When rowers row together in one shell, their motions must be synchronized. Positive group dynamics and interactions of rowers engendered by the synchronization are among the benefits of group rowing.

Live rowing of a shell on water is not only good exercise and provides stimulating interaction with other rowers, it also can offer an invigorating outdoor experience in a natural open environment. Yet rowing facilities can be expensive to use, hard to reach, or unavailable. Even when a facility is available and nearby, rowing in only one location again and again can be boring.

The biomechanics of rowing are complex. In typical live rowing of a shell on water the rower moves the handle of an oar in repeated strokes of rowing motion. Each stroke includes four successive phases sometimes called catch, drive (or power), release, and recovery. During each stroke, the rower's hands move with and impose forces on the handle of the oar. The forces vary in response to a profile of resistance (drag) imposed on the blade of the oar by the water—from almost no force to substantial pulling during the drive phase. During each stroke, the rower's seat glides back and forth on rails relative to the shell as the shell moves through the water at varying speeds.

Rowing experiences that attempt to mimic live rowing in a shell on water can be provided by stationary rowing machines. A typical rowing machine has a seat that glides back and forth on rails and a handle coupled by a chain to a mechanism that resists the rower's pulling of the handle in a profile that approximates at least part of the resistance profile characteristic of live rowing on water. Resistance mechanisms of rowing machines include air fans, water paddles, weights, hydraulics, or magnets. Rowing machines that use air fans typically have a large footprint and are noisy especially during intense rowing.

SUMMARY

In general, in an aspect, a rowing technology includes a first rowing machine having an electromagnetic brake providing a resistance to a rower of the machine in each rowing stroke of a series of rowing strokes of the rower. An electronic controller causes the resistance of the electromagnetic brake to vary over each rowing stroke in a profile that emulates resistance to which another rower in a shell on water or on a second rowing machine is subjected in each rowing stroke of a corresponding series of rowing strokes.

Implementations may include one or a combination of two or more of the following features. The electromagnetic brake includes a rotating electromagnetic element. The electromagnetic brake includes a linear electromagnetic element. The electromagnetic brake includes an electromagnet. The electronic controller includes logic that controls power delivered to the electromagnetic brake to cause the resistance of the electromagnetic brake to vary according to the profile during each of the rowing strokes. The electronic controller includes storage for information representing the profile. A receiver receives a stream of data representing timing of the series of rowing strokes of the other rower in the shell or on the second rowing machine. The electronic controller includes logic that controls power delivered to the electromagnetic brake to cause the resistance of the electromagnetic brake to vary in accordance with the received stream of data. The profile of the resistance of the electromagnetic brake corresponds to a rowing context of the series of rowing strokes of the other rower in the shell or on the second rowing machine. The context includes a presence or absence of a coxswain. The context includes a number of rowers. The context includes a weight class. The context includes age. The context of the series of rowing strokes includes at least one of a skill level of the rower or the other rower, a location of the rower or the other rower, a configuration or rigging of an oar used by the rower or the other rower, a configuration of a shell used by the rower or the other rower, a configuration of the rowing machine or the second rowing machine, a complement of rowers of a group to which the rower belongs, or a gender of the rower or the other rower. The presentation device provides a presentation to the rower of the series of rowing strokes of the other rower. The rowing strokes of the other rower in the presentation are synchronized with the resistance of the electromagnetic brake caused by the electronic controller. The presentation device includes at least one of an audio or video presentation device. The presentation device includes a smart phone or a tablet or a laptop computer. An app running on the presentation device is configured to synchronize the presentation with the resistance. The presentation includes a recorded video of the other rower rowing a shell on water in a real-world environment. The presentation includes real-time streaming video of the other rower rowing the shell on water in a real-world environment. The presentation includes a recorded video of the other rower rowing the second rowing machine. The presentation includes real-time streaming video of the other rower rowing on the second rowing machine. The first rowing machine has a footprint on a surface on which it rests that is smaller than 15 square feet. The first rowing machine has a length less than 86 inches.

In general, in an aspect, an audio or video presentation is presented to a first rower on a first rowing machine, portraying motion of another rower during each rowing stroke of a series of rowing strokes of the other rower on a second rowing machine or in a shell on water. The portrayed motion of the other rower is consistent with a data stream representing the motion of each rowing stroke of the series of rowing strokes of the other rower. The data stream causes the rowing machine to provide resistance for each stroke of a succession of rowing strokes of the first rower that varies over time consistently with resistance to which the other rower is subjected in each rowing stroke of the series of rowing strokes of the other rower.

Implementations may include one or a combination of two or more of the following features. The data stream is collected live in real time from the motion of the other rower while the first rower is on the first rowing machine. The data stream includes one or more of a stroke rate, a stroke length, a shell speed (e.g., a virtual shell speed), or a power measurement. The data stream includes an archived data stream. The data stream includes a live data stream. The first rower can select the data stream from among two or more data streams at least one of which includes an archived data stream and the other includes a live data stream. The data stream is received at the first rowing machine from a remote location. The audio or video presentation includes scenery of a rowing shell being rowed on water in a real-world environment. The data stream includes a stroke rate and a shell speed, and the strokes or speed portrayed in the audio or video presentation are synchronized temporally with the data stream.

In general, in an aspect, a social rowing experience is provided. A first data stream is collected representing motion of each stroke of a first series of strokes from a first rower of a group of two or more rowers each rowing on a rowing machine or in a shell on water. A second data stream is collected representing motion of each stroke of a second series of strokes from a second rower of the group. The first data stream is processed to generate a first display stream and the first display stream is communicated to a presentation device of the second rower. A rower interface is presented on the presentation device for the second rower to select a field of display from the first display stream. The second data stream is processed to generate a second display stream. The second display stream is communicated to a presentation device of the first rower. A rower interface is presented for the first rower to select a field of display from the second display stream.

Implementations may include one or a combination of two or more of the following features. Rowing performance metrics contained in the first data stream are displayed to the second rower. A resistance of each stroke of a succession of rowing strokes of the second rower on the rowing machine is adjusted to correspond with rowing performance metrics contained in the first data stream. Audio or visual cues are provided to the second rower to correspond with rowing performance metrics contained in the first data stream. The rowing performance metrics include power or torque measurements. The rowing performance metrics include stroke rate, stroke length, or shell speed. The first data stream is communicated to a server and the second data stream is communicated to the server. The first data stream is communicated to a presentation device of the second rower from a server and the second data stream is communicated to a presentation device of the first rower from the server.

In general, in an aspect, a rowing machine includes a chassis having a footprint of less than 15 square feet when configured for rowing by a rower. An electronic controller modulates an electromagnetic brake to provide a resistance to a rower of the machine in each stroke of a series of strokes of rowing motion of the rower. The provided resistance conforms to a resistance profile corresponding to a target rowing scenario.

Implementations may include one or a combination of two or more of the following features. No portion of the electromagnetic brake is located more than 22 inches horizontally from a vertical plane defined by the balls of the rower's feet when the rower is seated in position for rowing on the rowing machine. The electromagnetic brake is enclosed within a portion of a rail on which a slideable seat is mounted, and the rail extends no more than 48 inches horizontally from a vertical plane defined by the balls of the rower's feet when the rower is seated in position for rowing on the rowing machine. There is a rower interface for selecting the resistance profile. The electronic controller is configured to receive the resistance profile as the rower rows on the rowing machine. The resistance profile corresponds to a resistance experienced by a rower rowing in a shell on water or on another rowing machine. The rower rowing in a shell on water is within a predetermined body weight and height of the rower. The rower rowing in a shell on water is the same gender as the rower. The rower rowing in a shell on water is in a coxed four or a coxed eight. The rower rowing in a shell on water is using a single oar or two oars. The chassis has a footprint of less than 5.5 square feet when configured for storage. The target rowing scenario includes a rowing race. The target rowing scenario includes a group of rowers rowing. The target rowing scenario includes a single rower rowing alone.

In general, in an aspect, with respect to a data stream representing a motion of each stroke of a first series of strokes of a first rower in a shell on water or on a first rowing machine, receiving at a second rowing participation device of a second rower on a second rowing machine an audio or video presentation portraying the motion of the first rower during each stroke of the first series of strokes according to the data stream. The second rowing machine provides resistance for each stroke of a succession of rowing strokes to the second rower that varies over time in accordance with the resistance to which the first rower is subjected in each of the first series of strokes.

Implementations may include one or a combination of two or more of the following features. The presentation is received at the second rowing machine wirelessly. The second rowing participation device rowing machine receives a real-time rowing data stream collected from the participation device of the first rower. Audio or visual cues are provided to the second rower to enable the rower to emulate the rowing motion of the first rower. A stroke rate or a shell speed of the first rower is displayed to the second rower. The second rower can select a resistance profile and the second rowing machine receives the selected resistance profile from a server. The audio or video presentation includes a computer generated overlay presenting performance metrics of the first rower. The performance metrics of the first rower include stroke rate, speed, stroke length, or power. At the participation device of the second rower a video feed portrays scenery in the environment of the shell as it moves through water. A video presentation is presented to the second rower on the rowing machine portraying the scenery of a real or virtual shell on water. The real or virtual shell is portrayed as moving over water at a speed synchronized with a calculated speed of the second rower on the second rowing machine.

In general, in an aspect, a live data stream is received representing a rowing motion of a first rower in a shell on water. A representation of the live data stream is presented to a second rower on a rowing machine. An audio or video presentation portraying the rowing motion of the first rower according to the live data stream is displayed to the second rower. The live data stream portrays scenery in the environment of the first rower rowing in the shell on water. The live data stream is received at a participation device of the second rower through a wireless Internet connection. The first and the second rowers are racing each other. An instructional data stream includes audio or video commentary of a coach. The live data stream includes a video of the first rower in a shell on water.

In general, in an aspect, a rowing machine includes a chassis having a footprint of less than 15 square feet when configured for rowing by a rower and a longitudinal rail. A seat is slidably mounted on the longitudinal rail. There is a footrest on the longitudinal rail. An electromagnetic brake provides a resistance to a rower of the machine in each stroke of the rower. The electromagnetic brake is coupled to or includes a rotatable flywheel centered on an axle. A handle is mechanically connected to the axle by a tensile force transmitter. A one-way clutch mechanically connects a first location of the axle bearing the flywheel with a second location of the axle mechanically connected to the handle. A sensor measures an angular position of the flywheel. A retractor returns the handle to a starting position during a recovery phase of each stroke of rowing motion of the rower. An electronic controller varies an electrical current applied to the electromagnetic brake to provide a resistance profile.

Implementations may include one or a combination of two or more of the following features. The electromagnetic brake is circular. The electromagnetic brake is co-axial with the flywheel. The electromagnetic brake is linear. A receiver receives a data stream from a server and the electrical current applied to the electromagnetic brake changes according to the data stream. An interface enables a rower of the rowing machine to provide commands to the electronic controller. The interface includes a touch-screen. The interface includes an audio interface. The interface communicates wirelessly with the electronic controller. A sensor detects a speed, a direction, or a position of the seat along the longitudinal rail. A sensor detects a position of the handle. A sensor detects a force applied to the handle by a rower of the rowing machine. A display presents performance data of the rower of the rowing machine. The electromagnetic brake is circular and operates as the flywheel.

In general, in an aspect, a video capture system includes a first camera mounted nearer to the bow of a shell to provide a first data stream including video wirelessly to a remote storage location. A second camera is mounted nearer to the stern of the shell to provide a second data stream including video wirelessly to the remote storage location. A third camera is mounted on a body of a rower rowing in the shell, providing a third data stream including video wirelessly to the remote storage location, Implementations may include one or a combination of two or more of the following features. The first, second, and third cameras collectively capture a 360-degree view, from a rower's perspective, of a waterway on which the shell is located.

In general, in an aspect, a video capture system includes a first camera mounted nearer to the bow of a shell to provide a first data stream wirelessly to a remote storage location. A second camera is mounted nearer to the stern of the shell to provide a second data stream wirelessly to the remote storage location. A third camera is mounted on a vehicle conFigured to visually track the shell to provide a third data stream wirelessly to the remote storage location, Implementations may include one or a combination of two or more of the following features. The vehicle includes a flying drone. The vehicle includes a human or machine powered shell.

The first, second, and third cameras collectively capture a 360-degree view, from the rower's perspective, of a waterway on which the shell is located.

In general, in an aspect, a rowing video system includes a camera mounted on a shell or another carrier to capture a video of the rower in the shell as the rower rows. A display presents the video to a rower on a rowing machine.

Implementations may include one or a combination of two or more of the following features. A transmitter wirelessly transmits the video to a remote location for storage. A communication component streams the video in real-time to a participation device of the rower on the rowing machine. A body camera is configured to be mounted on the body of the rower in the shell rowing on water to provide a second video to the display presented to the rower on the rowing machine. A shell camera is configured to be mounted on the shell on water in which the shell camera provides a third video to the display presented to the rower on the rowing machine. An interface on a participation device of the rower on the rowing machine enables the rower to select one or more of the first, second, and third videos. The other carrier includes a flying drone. The other carrier includes a power shell.

In general, in an aspect, a rowing technology includes a rowing machine having an electronically variable resistance profile. There is a receiver for a data stream representing a motion of each stroke of a first series of strokes of each live rower in a shell having between two and eight rowers. An interface enables a rower on a rowing machine to select a virtual seat position in a virtual shell having two to eight seats. A controller causes the rowing machine to provide resistance for each stroke of a succession of rowing strokes of the rower on the rowing machine that vary in accordance with a stroke motion of the live rower seated in front of the virtual seat position.

Implementations may include one or a combination of two or more of the following features. A participation device provides to the rower of the rowing machine an audio or video presentation portraying the motion of the live rower seated in front of the virtual seat position. The controller is configured to cause the rowing machine to provide resistance for each stroke of a succession of rowing strokes of the rower on the rowing machine that vary in accordance with a stroke motion of the live rower seated behind the virtual seat position.

These and other aspects, features, and implementations (a) can be expressed as methods, apparatus, technology, components, program products, methods of doing business, means or steps for performing a function, and in other ways and (b) will become apparent from the following description, including the claims.

DESCRIPTION

FIGS. 1 through 4, 6 through 10, and FIG. 21 are block diagrams.

Here, we describe a set of technologies (which together we sometimes call the "rowing technology" or simply the "technology") that can materially improve rowing experiences for individual rowers and groups of rowers, especially rowing experiences that involve rowing machines.

Among the benefits of the rowing technology are the following. The experience of rowing on a rowing machine can more realistically simulate the experience of live rowing. The rowing machine can be used intensely while producing noise at a lower level than other rowing machines. The rower's rowing motion can be synchronized effectively with one or more other rowers who are live rowing on water or using rowing machines. The experience of group rowing can be achieved realistically. The rowing machine can occupy a smaller floor area than other rowing machines. Social interaction and networking in the context of rowing is enhanced.

We use the term "rowing machine" broadly to include, for example, any exercise platform that enables a rower to perform a repetitive rowing motion (e.g., a stroke) such as pulling a handle against a resistance force or resistance profile from one position (e.g., a catch position or retracted position) to another position (e.g., a release position) by retracting the rower's arm or arms or extending the rower's legs and torso, or both, in motions that are similar to or identical to strokes that occur in live rowing on water. In typical rowing machines, after the rower has pulled the handle from the one position to the other position, and the rower stops pulling, the rowing machine returns the handle to the first position.

Figure 1:
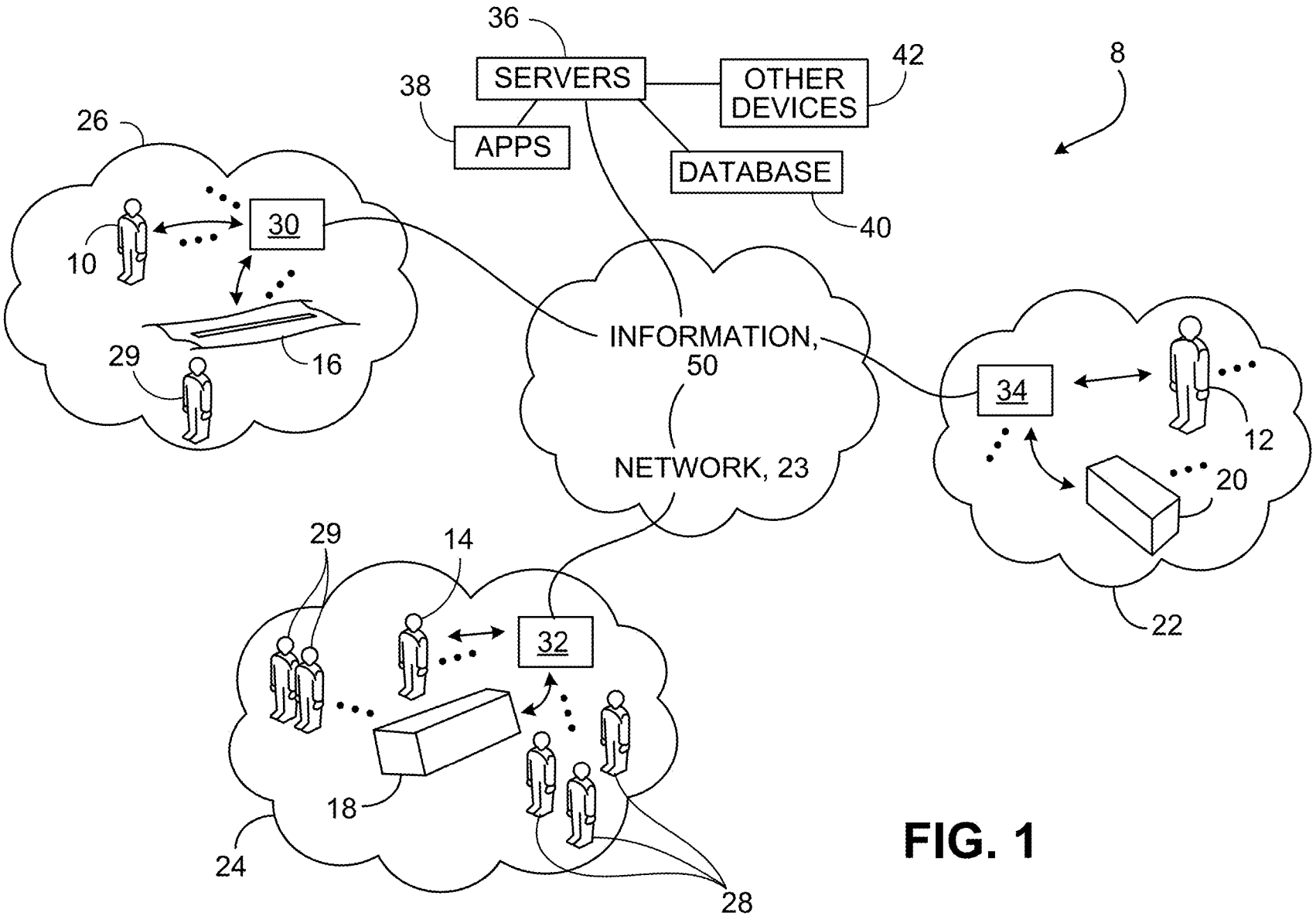

As shown in FIG. 1, in some implementations, the rowing technology 8 may be used by large (even extremely large) numbers of rowers 10, 12, 14 who are engaged in rowing either on water 16, on a new kind of rowing machine 18 that is part of the rowing technology described here, or on known brands and models of rowing machines 20. We sometimes refer to rowers who are using rowing machines as "machine rowers," and to rowers engaged in live rowing on water as "water rowers."

The locations 22, 24, 26 of the rowers can be anywhere in the world at which suitable connections to a communication network 23 (such as the Internet) can be achieved by physical attachment or wirelessly connection. (Although only one of the rowing regimes—rowing on water, rowing on the new kind of rowing machine, and rowing on known brands and models of rowing machines—is shown at each location in the Figure, each location could involve any combination of the three rowing regimes.) We sometimes refer to rowers or rowing machines or shells that are served by a connection to a communication network as "connected rowers," "connected machines," and "connected shells."

We use the term "shell" broadly to include, for example, any watercraft that is human powered by an oar (or oars) or oar-like devices, moved by the rower's arms, such as a racing shell, a rowing shell, a row-boat, a kayak, or a canoe, to name a few.

The connected rowing machines can be stationary and in use at a given time at many (and potentially thousands or even millions of) locations including in buildings or outdoors. Each of the connected shells can be stationary or moving at a given time on any water body suitable for rowing anywhere in the world.

Rowers who use the rowing technology may be rowing in groups, which we sometimes call "rowing groups." The members of a rowing group 28 can be physically present with one another at a particular location, for example, two or more rowers in a single shell or in two or more shells on the same body of water or two or more machine rowers in a room or outdoors. A rowing group can also be what we sometimes call a "virtual rowing group" of two or more rowers 29 who are not all physically present with one another, for example, one or more machine rowers in one location grouped with one or more machine rowers in a different location. In some cases virtual rowing groups can include one or more water rowers. In some implementations, virtual rowers generated by the technology can also be part of the rowing groups.

To be electronically connected (and therefore to participate) as part of the rowing technology, a rower, machine, or shell is served by one or more of what we sometimes broadly call "participation devices" 30, 32, 34. Participation devices provide connections to a communication network, on one hand, and can provide connections to connected machines, connected shells, connected rowers, other participation devices, and other entities, on the other hand.

As examples, the participation devices of connected rowers, connected machines, and connected shells can include one or a combination of two or more of the following: workstations, computers, special purpose hardware, sensors, controllers, laptops, smart phones, tablets, or other mobile or stationary devices, among others. In some cases, participation devices can be running software, hardware, or firmware designed to make the participation devices useful with the rowing technology. We sometimes call the software, hardware, and firmware "rowing apps." The participation devices can be commercially available or custom-built. In some cases, the participation devices can be physically and electrically unattached to the rower, the machine, or the shell even though they are connected to the communication network. In some cases, the participation devices can be physically connected, electrically connected, or both to the connected rower, the connected machine, or the connected shell. A participation device can be connected at some times to the communication network or to the connected rower, the connected machine, or the connected shell, and at some times can be unconnected. Participation devices can include instrumentation for connected machines, connected shells, and connected rowers. The instrumentation can include sensors to measure a variety of parameters associated with the machine, shell, or rower and sensor electronics to drive the sensors and communicate with other participation devices or the servers.

Parts of the rowing technology can be implemented at one or more rowing servers 36 running one or more rowing apps 38 and maintaining one or more rowing databases 40. The servers are connected to the communication network for communication with the participation devices and with other devices 42 to provide information from the servers to the participation devices and other devices and to acquire information from the participation devices and other devices for use at the servers. In some instances the other devices 42 can communicate directly with the participation devices 30, 32, 34 to provide and receive information. In typical uses of the rowing technology, most (but not necessarily all) of the communication of each of the participation devices is either with the servers, or if it is with other participation devices passes through the servers as an intermediary. In some cases, participation devices can communicate with other participation devices directly without involving the servers.

The rowing server connections with the participation devices enables, among other things, the rowers to interact with other rowers rowing in shells on water or on other rowing machines and experience rich dynamic interactions with other rowers, real or virtual, in real-time or in a time-shifted scenario.

We use the term "rowing server" or simply "server" broadly to include, for example, any kind of device or devices that include storage, applications, operating systems, processors, and other devices and software, and can provide features, functions, and any other kind of services through a communication network to one or more rowing machines, shells, rowers, participation devices, content editing locations, or other devices or equipment. A server can include one or more servers or a server farm located in one or more places.

A participation device running a rowing app at one of the locations can provide a wide variety of functions as part of the rowing technology. In some cases, the participation device can serve as a presentation device that includes a display, a speaker, a haptic facility, or other output facilities, or combinations of them to provide information and facilitate rowing experiences to the rower. In some instances, the participation device receives information through a microphone, a keyboard, a touch screen, a camera, a wireless connection, wired connection, or other input facilities, or combinations of them from a machine, a shell, a rower, or another participation device. The participation device uses that information locally or communicates it to another device or to the server for processing, use, and possible forwarding to other devices.

We use the term "rowing app" broadly to include, for example, any application that runs on a participation device, a server, or another device and enables rowers of rowing machines and shells to communicate with, exchange information with, and otherwise engage in interaction with a participation device, a server, a rowing machine, other rowing machines, or other rowers. In some instances, the rowing app can provide an interface for the rower to control the rowing machine or a rowing experience, rowing scenario, rowing session, or rowing context. In some instances, the rowing app can display the rower's personal data and rowing performance data from current and past rowing sessions. In some instances, the rowing app enables the rower to connect to the social rowing network on the rowing server and also connect to other online social networks. In some cases, the rowing app can be downloaded from an app store. In some examples, a copy of a rowing app is installed on a computer that is built into a rowing machine. In some cases, a rowing app can also record and display a rower's personal values of rowing parameters and maximums and minimums of each parameter. A rowing app, in connection with the rowing server, can synthesize the rower's rowing performance data and provide coaching tips and advice. In some instances, a real-life rowing coach may review rower rowing data and provide coaching advice remotely to the rower through the server and the rowing app. In some cases, the rowing app or the rowing server stores a rower's rowing session history on the rowing technology, and can provide the rower with a list of past rowing sessions and the information associated with each of the sessions.

The rowing technology can be applied to a virtual rowing group or other rowing group by enabling one or more rowers of the rowing group to synchronize or otherwise coordinate their respective rowing motions (strokes). The coordination of rowing motions enhances the rowing experiences of the rowers in the rowing group, especially the machine rowers. The coordination of the rowing machines is achieved by communication among participation devices associated with the connected rowers, connected machines, and connected shells of the rowing group. In effect, the rowing technology provides an online social networking environment that enhances social interaction among two or more rowers of the rowing group by exchanging information 50 about their respective rowing motions.

We use the term "rowing motion" broadly to include, for example, the motion of a person moving an oar or paddle during rowing of a shell on water, or of a rowing machine, or of any other device that is human powered by one or more oars or paddles or oar or paddle simulating devices moved by the rower's arms, legs and/or torso. The term "stroke" is sometimes used interchangeably with "rowing motion."

Although the information 50 can be exchanged in real-time for a real-time group rowing experience, in some instances, the information exchange can also be time-shifted with respect to one or more of the rowers in the rowing group. This time-shifting enables rowers to row together in a virtual group rowing experience when in reality they are or have been rowing at different times.

The social interaction aspects of the rowing technology can include a ranking system for rowers that handicaps rowers for fair competition, allowing rowers of different genders, ages, and rowing classes to race each other or row together in training. As an example, a rower using one rowing machine may be ranked lower on an absolute performance scale than a second rower using a second rowing machine, because the first rower is a lightweight rower and the second rower is a heavyweight rower. In some implementations, the rowing technology can handicap the resistance profiles of the two rowing machines (for example, by instructions sent from the server to participation devices associated with the two rowing machines or rowers) to enable the two rowers to race each other competitively.

The social interaction enabled by the rowing technology also produces more mental stimulation for improved training response and less boredom.

In some implementations, the social networking environment enables real-time or time-shifted pre-recorded (audio or video) coaching by a real or virtual coach using one of the rowing machines or a shell to help improve the form and fitness of one or more rowers using another rowing machine or shell. The rowing technology provides an exercise platform for improved rowing performance by immersing the rower in both physical and mental simulation of live rowing in a shell on water.

The rowing technology includes rowing machines that, in some instances, provide controllable resistance profiles emulating the time-varying resistance experienced during successive strokes in selected rowing scenarios and rowing contexts, for example, while rowing on water or, in some cases, while rowing on particular brands or models of other rowing machines.

We use the term "resistance profile" broadly to include, for example, any level or kind of resistance over time that a rower experiences when pulling on the handle of a rowing machine or when rowing on water or in any other rowing context or rowing scenario. In some cases, the resistance profile of the rowing technology can be varied, controlled, or adjusted so that for a given rowing motion on the rowing machine to accommodate any possible rowing context or rowing scenario or other rowing situation. A resistance profile can be as simple as a constant resistance over time or can encompass a resistance that changes from moment to moment. Resistance profiles can be generated, stored, altered, edited, optimized, enhanced, and processed and managed in any other way for use in the rowing technology.

We use the term "rowing scenario" broadly to include, for example, a rowing situation associated with a location, water condition, weather condition, or other factor or combinations of them, such as a rowing on choppy water in 30° F. weather in the southern hemisphere, that may suggest or dictate video clips, information, connections, and other characteristics that can be used to effect a rowing session or rowing experience related to the rowing scenario.

We use the term "rowing context" broadly to include, for example, one or more circumstances of a rowing experience or rowing scenario, such as the age, gender, height, weight, experience level, reach, and other characteristics of a rower; characteristics of a shell (size, shell model, rigging, weight, materials, bow shape, and others); shell classes (e.g., 1×, 2×, 2−, 4−, 4+, 4×, 8+); characteristics of oars (blade shape, length, weight, and others); the type of rowing, such as water rowing or machine rowing; the rowers involved, such as solo rowing, rowing as part the crew of a double or a pair, rowing as part of a crew in a four or a eight, rowing solo in a race against other solo shells, rowing as part of a crew in a multi-person shell against other multi-person shells, rowing next to a skiff with a coach onboard; and others.

We use the term "rowing experience" broadly to include, for example, the nature of the involvement of a rower using a shell or a rowing machine such as a connected rowing machine of the rowing technology. In some instances, a rowing experience is a result of a rower selecting a rowing scenario or a rowing context. For example, a rower could receive a rowing experience of rowing on the Charles River in Boston in a single scull by selecting a Charles River rowing scenario and a single scull rowing context. In some cases, the rowing experience can be presented to each machine rower as live video streams from the rowing server showing one or more other shell rowers or machine rowers rowing for recreation, in training, or in a race. In some cases, the rowing experience can be presented using pre-recorded video streams of the rower (or one or more other rowers) previously rowing in a shell on water or on a rowing machine. In some cases, virtual reality features can be included in the presentations to the rowers for an immersive experience. The virtual reality features could include the sound of the oar entering water, vibration through the handle of the oar as it is enters and exits water, views of other rowers rowing in the same shell, views of other rowers rowing in other shells, immersive three dimensional scenery, and combinations of those.

In some cases, the rowing machines of the rowing technology are customizable by the rower to provide rowing experiences that mimic rowing in chosen rowing scenarios and rowing contexts, for example, on water in a variety of waterways or rowing on any rowing machine. In some implementations, the rowing machines are quieter than rowing machines that use air fans to generate resistance. As a result, rowing on the rowing machines more closely mimics on-water rowing during which most of the noise from rowing on water comes from the oars entering and exiting the water. In some examples, the rowing machines of the rowing technology include participation devices designed for audio-visual presentations of rowing information and rowing experiences, such as rowing performance parameters and video clips of rowing on water or rowing on another rowing machine, among other things.

Sometimes, the participation devices associated with the rowing machines have rower control interfaces that allow the machine rowers to control or select rowing scenarios from a variety of rowing scenarios and to connect the rowing machines to the rowing server. In some instances, the rower can also use the control interface to select rowing contexts from a variety of rowing contexts. The control interface can have physical buttons, touch screens, graphical rower interfaces, or voice commands. The rowers can control and customize the rowing experiences on the rowing technology by using the control interfaces to select rowing scenarios or rowing contexts or both. In some instances, the control interfaces are supported by rowing apps running on a participation device mounted on the rowing machines. In some instances, the control interfaces are rowing apps that run on participation devices that are tablets, smartphones, or other general-purpose Internet connected devices that are coupled to the rowing machines of the rowing technology either wirelessly or by a cable and in some cases mechanically. The control interfaces of the rowing apps communicate with the rowing server and provide the rower with options for selecting rowing scenarios and performing other rower functions.

Figure 2:
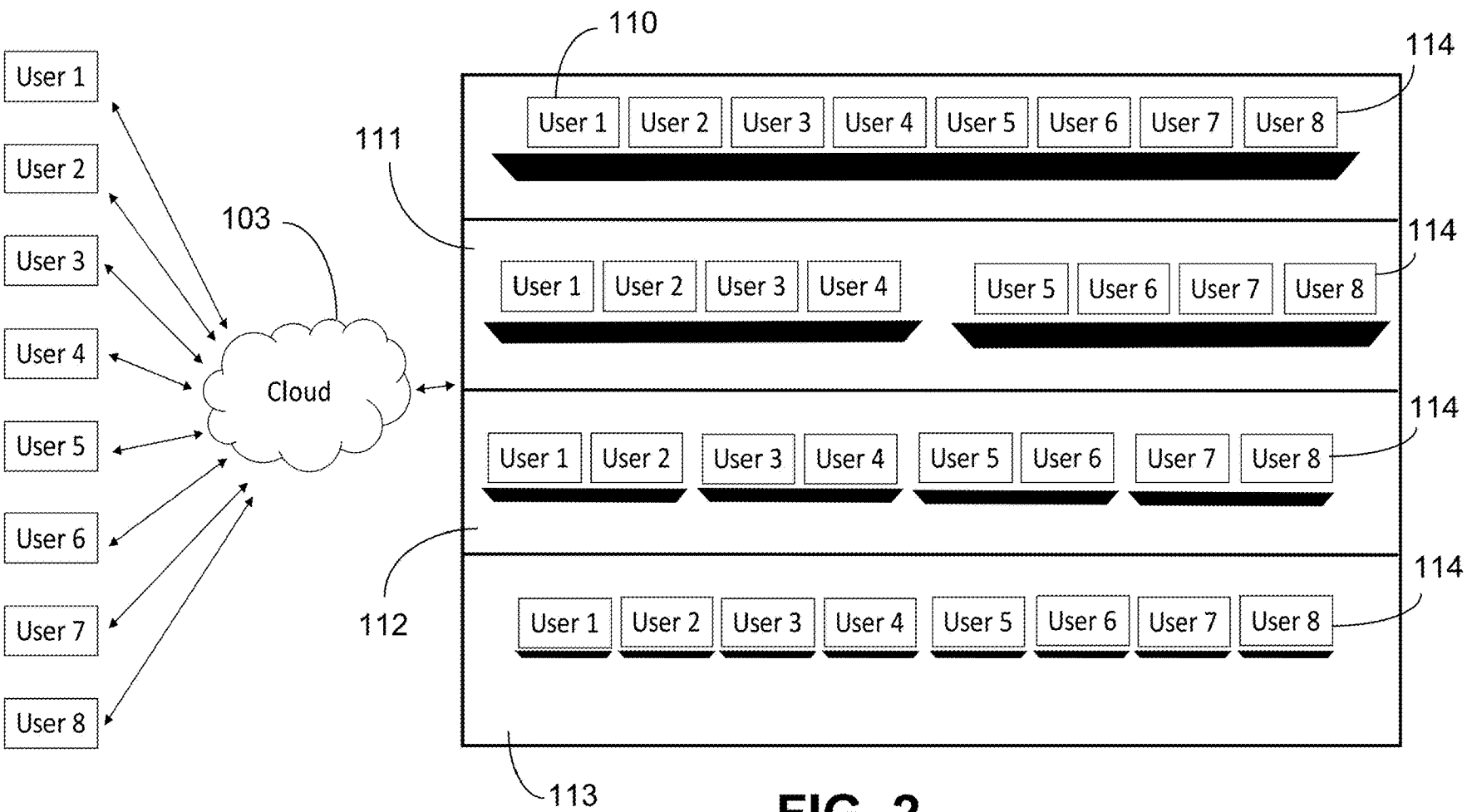

In an example shown in FIG. 2, rowers 1 through 8 (called "users" in the figure) are on rowing machines that are connected to a rowing server 103 ("cloud"). The rowing server 103 provides the presentation device on the rowing machine of each rower one of four possible video presentations each representing a rowing context eights—eights 110, fours 111, pairs 112, or singles 113—corresponding to a selected rowing scenario and rowing context from a library 114 of rowing scenarios and rowing contexts stored in the database at the server. In the example shown in FIG. 2, the four video presentations in the library 114 show four rowing contexts of shells having different numbers of rowers such as eights 110, fours 111, pairs 112, and singles 113.

Figure 3:
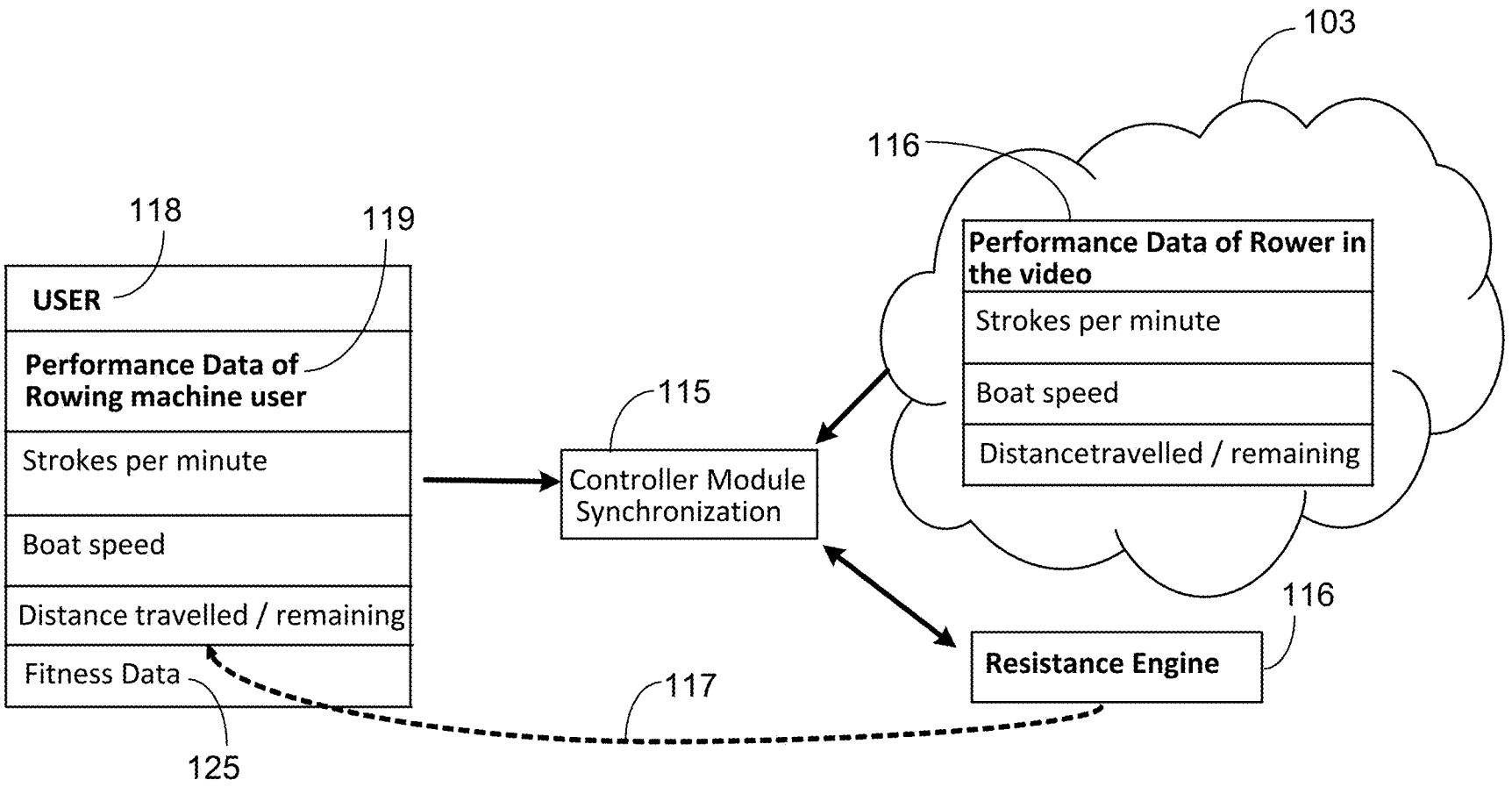

Generally, the rowing technology provides rowing scenarios and rowing contexts that combine presentations of real-world rowing-on-water scenes to the rower, and coordinates resistance profiles that correspond, for example, to the real-world rowing-on-water scenes that are being presented to the rower. As shown in the example in FIG. 3, a presentation device ("controller module") 115 of the rowing machine 101 receives performance data of the rower in the video 116, such as the video rower's stroke rate, shell speed, and distance travelled/remaining. The controller 115 communicates with the resistance engine 116 of the rowing machine 101 to vary the resistance profile 117 that the rowing machine rower 118 of the rowing machine 101 experiences, based on the performance data of the rower in the video 116. In some cases, the controller 115 is part of or is associated with a participation device that receives performance data of the rowing machine rower 119, such as the rowing machine rower's 118 stroke rate, shell speed, and distance traveled or remaining. The controller 115 can vary the resistance profile 117 that the rowing machine rower 118 of the rowing machine 101 experiences, based on the performance data of the rower 119.

In various implementations, the server provides a variety of functions.

Figure 4:
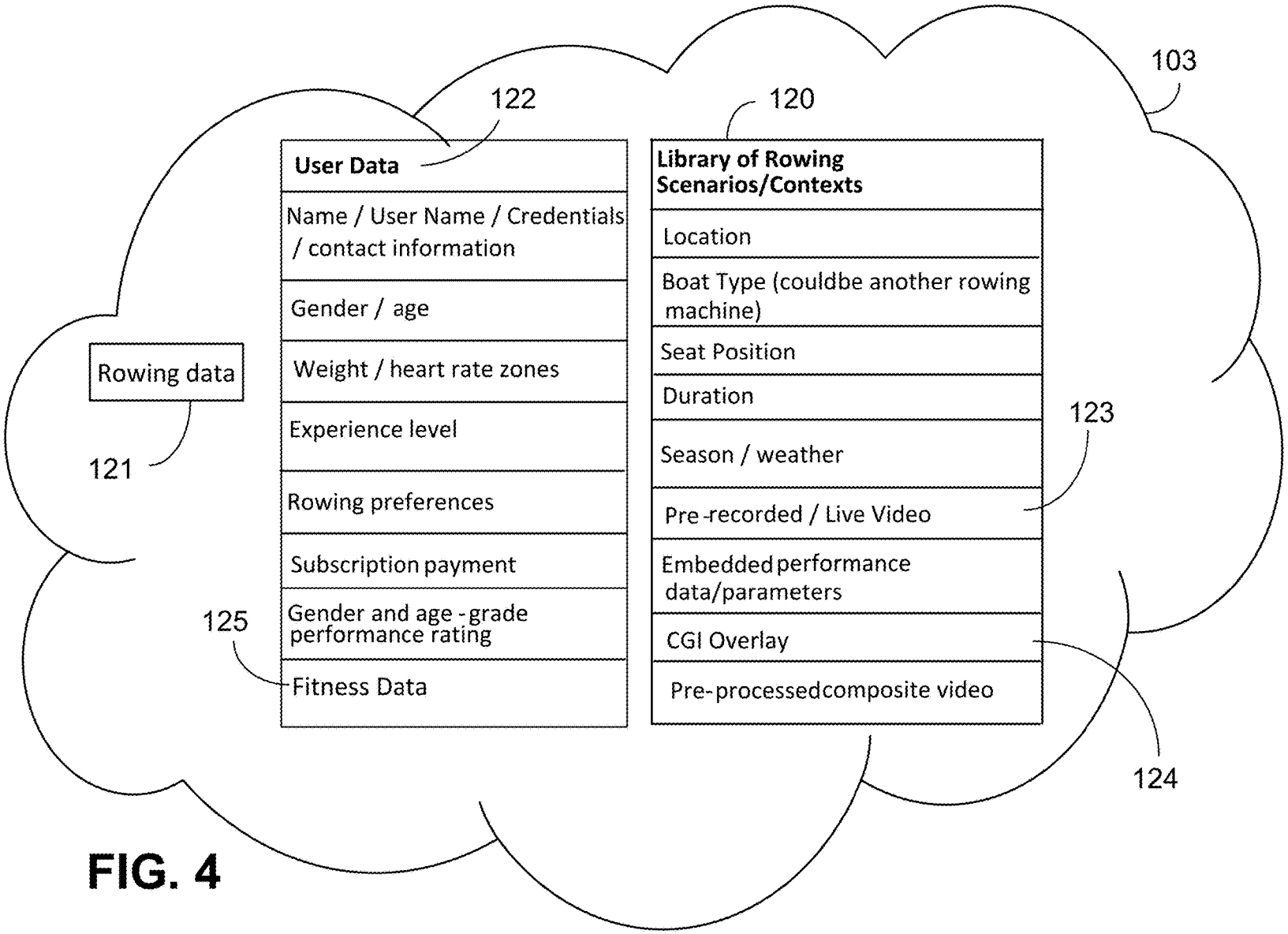

For example, as shown in FIG. 4, the rowing server can store in and retrieve from the rowing database a wide range of fields of information useful in providing rowing experiences for rowers. For example, the records of the database can contain a variety of fields. The fields of certain records define rowing scenarios and rowing contexts 120 defining characteristics of rowing experiences to be provided to rowers. The fields of some records represent registration and profile information about rowers and other rower data 122. The rowing database at the rowing server can be a repository of rower information, rower accounts, and rower preferences as part of the rower data. And the fields of some records capture rowing data 121 that represent rowing motions to be sent to rowing machines to control, for example, the resistance profiles to be applied by the rowing machines for particular rowing scenarios and rowing contexts.

We use the term "rowing data" (or sometimes, "rowing performance data") broadly to include any kind of data about rowing or rowing motion of one or more machine rowers or shell rowers such as data about 500 meter splits, instantaneous power (watts), average power, maximum power, stroke rate (strokes per minute), count down timer, total meters rowed, average split, stroke length (meters), stroke duration (seconds), calories burned, heart rate (via ANT, ANT+, or other wireless heart rate monitor protocols), power curve, drag factor, drive time (seconds), force (N) applied to the handle, among other parameters or measures of rowing motion.

The library of rowing contexts and rowing scenarios 120 can include a database 123 of video content and audio content to be sent to participation devices associated with rowing machines for presentation as part of a rowing experience.

For example, the rowing server can receive data about rowing motion from participation devices associated with rowing machines and can relay the rowing motion data to participation devices of other rowing machines in real-time or time-shifted. In this way the rowers at different rowing machines can have their rowing motions synchronized.

In addition to relaying the rowing motion data, the rowing server can store the rowing motion data and can process and modify the data that it receives from rowing machines before storing or relaying the data to participation devices for other rowing machines. Among other actions, the rowing server can generate graphical, audio, or video content to be presented on participation devices to the rowers at the rowing machines.

In some cases, the rowing machines of the rowing technology provide rowers with resistance profiles that emulate resistance characteristics of one of or combinations of two or more of the rowing scenarios or rowing contexts or both. In some instances, the rowing machines of the rowing technology impose a given resistance profile on motion of the rower by applying electromagnetic braking supplied by eddy current brakes, motor-generators, motors, generators, or a combination of two or more of those electrical devices. In some instances, the rowing machines receive information from the rowing server and uses that information to determine a resistance profile to provide to the rower at a given moment. In some cases, the rowing technology can be used in a mode to promote precise synchrony between the detailed rowing motion of a first person using a rowing machine at one location and the detailed rowing motion of a second person rowing at another location (either on water or on another machine). As a motivational, recreational, or educational feature in some implementations, music can be synchronized to the rowing stroke. For example, a rower aiming to row at 30 strokes per minutes could choose to have the presentation device deliver music or audio stream having repeated beats of 30 per minute.

Among other ways, synchrony between one rower and other rowers of the rowing technology can be achieved by providing audiovisual cues to the first person that correspond to rowing motion of the second person and by configuring the rowing machine of the first person to have a resistance profile that bears a particular relationship to the resistance profile to which the second person is subjected as the second person is rowing. Similar correspondence can be drawn from the third, fourth, fifth, sixths, seventh, eighth, etc. rower that is on the networked rowing technology. In some cases, the rowing server that coordinates the information exchange can modify or alter the information of one rower before delivering it to others. In some cases for example, as shown in FIG. 4, the rowing server can synthesize computer generated overlays 124 that can be displayed over a background video. The overlays can be, for example, virtual images of the rower, the rower's ghost from a prior rowing session, other rowers, other rowing shells, a coach, a coach skiff, water rippling and splashing because of the motion of the oars and shell, and background scenery. The overlays can be, for example, numerical or graphical displays of the rower's rowing data. The rowing server can add stored information to the real-time information and transmit the combination to one or more of the individuals in the group.

The video clips of on-water rowing presented to the rowers of the rowing technology can be captured in real-time or in advance in prerecorded form. In some implementations, such as, for example shown in FIG. 5, the video clips can be captured using at least two video cameras 501 and 502 on a real shell 504, including one or more cameras mounted on the body of the rower 503. The video cameras, when mounted on the body of the rower, can use auto-focus to account for the fore and aft motion of the seat of the on-water rower relative to the shell. A wireless communication connection 505 such as cellular data network 506 can be used to stream multiple channels of live video from the shell to another location, such as to the rowing server 103. A video camera 508 equipped drone 507 can film an on-water rowing scene from the air and deliver via wireless communication network 509 the scene to a rowing server 103, which can provide the video to a display seen by a rowing machine rower. The video can also be stored locally at the camera and later transferred to the rowing server, from which the video can be transmitted to rowing machines for presentation to one or more rowers. The rowing technology can provide simulated experiences of rowing as part of a rowing crew by real time or time-shifted presentation to the rower of video and data representing stroke motions of other rowers in the crew.

In some instances, the rowing machines collect rower fitness data 125, such as power output and heart rate, and relays it to the rowing server 103. The rower fitness data can be communicated to the rowing server and stored in a private area of the rowing server accessible only to the rower or to others with the rower's permission. The rowing server can process the rower's fitness data to provide the rower with historic training and fitness information, as well as training advice and suggestions. A rower can use can use fitness data to improve rowing performance and health.

In some instances, to begin an exercise session on the rowing machine, a rower selects a rowing scenario from the rower interface using the rowing app. In some cases, the rowing app is a conduit between the rower and the rowing server. The rower can first provide credentials to log into the rower's account on the rowing apps. If the rower does not have an account on the rowing app, the rower can create one by entering personal identifiable information such as screen name, email address, password, zip code, address, phone number, photograph etc. The rower can enter personal information (i.e. birthday, gender), physical parameters (weight, height, max. heart rate, etc.), past performance parameters (stroke length, stroke rate, power versus recovery phase time, etc.), rowing experience level, past rowing session profiles, and other metrics that the controller/computer can process to provide the optimal rower experience for the current sessions. The rower's account on the app is stored, for example, as shown in FIG. 4, on the cloud 103 as rower data 122 and accessible via rower granted permission.

In some instances, the rowing app can be accessed via a log-in screen requesting rower identity information such as email or phone number or name or rowername, and a password. The log-in credentials may also be linked to common social network log-in credentials (i.e. accounts on Facebook, Linkedin, Twitter, etc.) such that the rower need not create or enter a separate rowing app account password. A rower profile is created and stored on the cloud, with access to the rower's profile protected by the rower's login-in credentials. The rower may give permission for the rowing app to link to and access the rower's other online social networking accounts such as Facebook, Twitter, Linkedin, Strava, Concept2 Logbook, and Instagram.

In some cases, once the rower logs into the rowing app and into the rower's account, the rower can select to begin a rowing session. The rower can choose from a variety of rowing scenarios and rowing contexts. For example, the rower can choose a rowing scenario to row on the Charles River in Boston. In some examples, the rower can choose a rowing context to row with one other rower in a double, and the rower is seated in the number one seat, and a coach provides coaching advice. In some examples, the rower can choose other rowing scenarios, such as, for example, rowing on Lago Di Como in Bellagio, Italy, on Lady Bird Lake in Austin, Tex., or in Yates Mill Historic County Park in Raleigh, N.C. Further in this example, the rower can choose other rowing contexts such as, for example, rowing in a double eight with one other in the number two seat, and compete against another shell. The rower can select the length of the rowing session for time and distance. In some cases, once the rower makes a selection of the rowing scenario and context, the session can begin. As the rowing session begins, the rower can be presented with a video/audio display of rowing on water.

Figure 6:
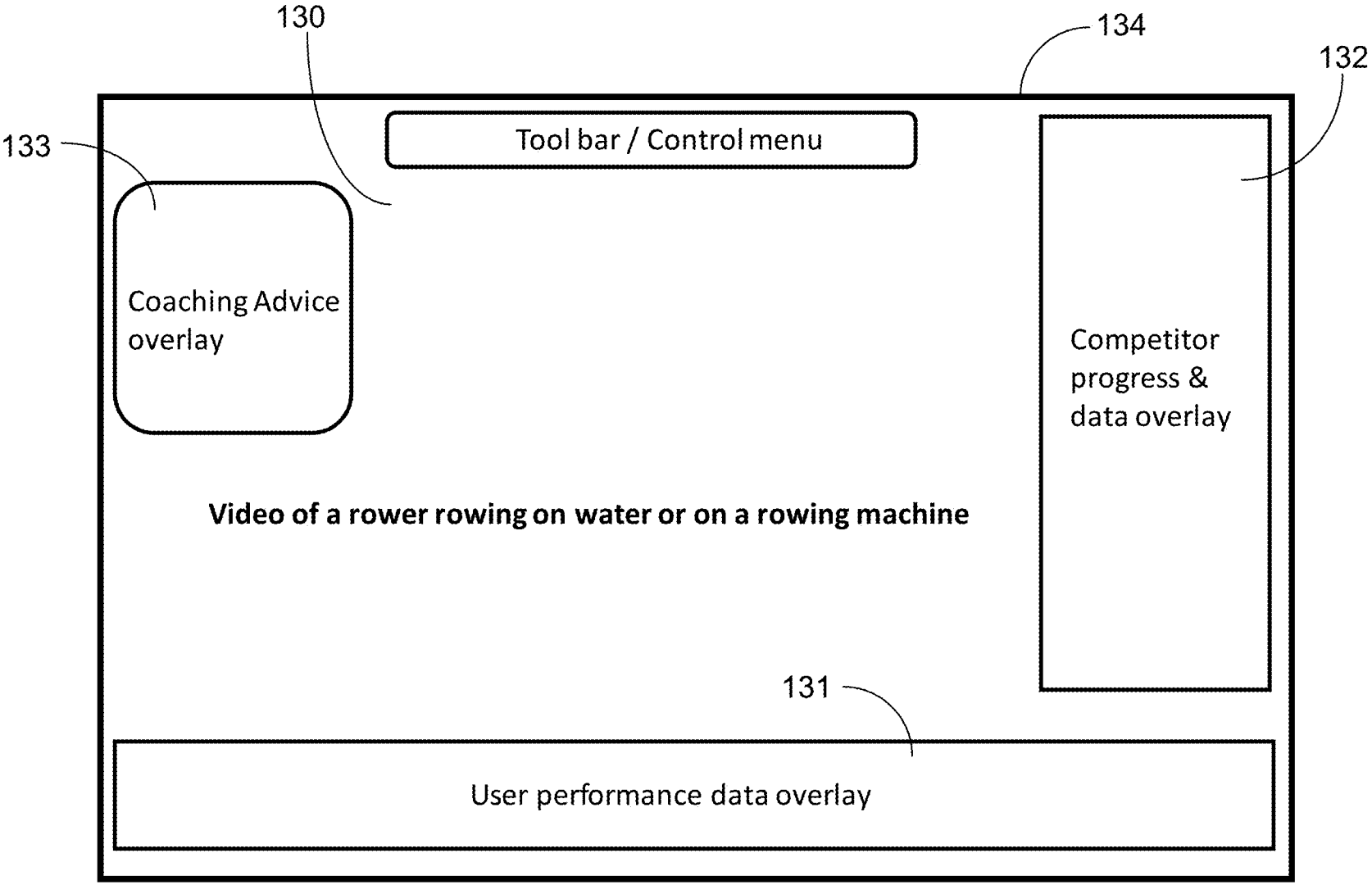

FIG. 6 illustrates an example of a screen 134 of a presentation device with information that the rower may see during a rowing session. The background of the display 130 is the scenery of open water with the shell and rower in the chosen scenario. In this example, the scenery would be Charles River and the shell a two-person shell having a sculling setup with a view of the second rower's back because the rower is sitting in the number one position. As shown in FIG. 6, rowing or rower performance data 131 such as power, power curve, drive time, stroke length, average pace (time per 500 m) elapsed time, strokes per minute, total distance, heart rate, calories burned, shell drag, among other parameters, etc. can be displayed over the video of on water rowing. The rower can further elect to see how other rowers have performed over the same course within the rowing server. In some cases, the rower can see a leaderboard 132 of other rowers' performances based on a variety of criteria such as age category, gender, and experience level. The rower can also see rowing tips and coaching advice on display during the rowing session to help improve form and performance. The rowing app can provide summary screens for the rower to analyze the rowing session either during the session or at the conclusion of the session. For example, the rowing app can provides a session or workout summary showing the averages of various instantaneous performance measurements such as average pace (time per 500 m), average power, average power curve, average stroke length, average heart rate, average stroke rate, average drive time, average drag, etc. The session summary can also show totals such as total calories burned, total time, total distance, total workout load, etc. The session summary can display the information in numerical or graphical format or a combination of formats.

In some examples, the rower can select from a rower interface a rowing scenario for rowing in a selected location from among a variety of locations (actual physical locations as well as simulated locations). In some instances, a given location can have a variety of scenarios based on season, weather condition, direction of travel, other shell traffic, etc. The variety of scenarios provides the rower with a variety of potential rowing experiences.

In some examples, the rower can select from a rower interface a rowing context for solo rowing, i.e. the rower is on the rowing technology without another rower participating in the rowing session. In some examples, the solo rowing context can be selected from among one or more of the following: (i) simulation of rowing on water in a selected shell from among a variety of shells (different sizes, sweep versus scull, riggings, etc.) and (ii) simulation of rowing on a rowing machine, including a particular brand or model of rowing machine, such as Concept 2. In some instances the display can present a video of the rower's chosen rowing scenario, such as scenery of a waterway from the perspective of a rower sitting in a shell and rowing the shell over water (i.e. the rower is facing the stern of the shell). The resistance engine can provide a resistance profile to the rower's rowing motion based on the rower's chosen rowing context. The resistance engine could provide resistance to the rower commensurate with the resistance expected of a particular shell type and seating position. In some cases, the rower can choose to have a coach provide feedback, encouragement, and instructions. In some cases, the coaching advice and information can appear as audio or text or graphic on the display, and a virtual image of a coach on a skiff would appear on the display. In some cases, in the solo mode, the rower can also perform exercises such as seated row, in which the seat remains in a fixed position. In some instances, the rower can manually select different resistance profiles in a custom mode. In some instances, the rower can select resistance profiles adapted to training and fitness testing such as interval sessions, stepped $VO_2$ test regimen, maximum heart rate test protocols, race start simulations, among other rowing contexts.

Alternatively, the rower can choose a rowing scenarios that is a ghost of the rower, i.e. a past rowing sessions of the rower, in which the shell on water is traveling at a certain speed over certain distance, or in which the past rowing session on a rowing machine was performed at a certain virtual shell speed. In some instances, this ghost alternative allows the rower to compare current personal performance to past performance. The presentation on the local device could provide feedback to the rower, for example, to prompt the rower to row at the same pace as a ghost shell from the chosen past rowing session. The controller could adjust resistance profile accordingly to provide the rower with the same resistance as that experienced by the rower in the chosen past rowing session.

In some cases, the rower can select a rowing context for rowing with one or more other rowers in a multi-person shell, such as described in the Charles River example discussed above. In some instances, the rower can select from the interface a rowing context for rowing in a multi-person shell against one or more shells on water or one or more rowing machines in a group training context. In some examples, the multi-rower mode allows the rower to race against another rower on water or on another rowing machine.

In some instances, when a rower selects the context of rowing in a multi-person shell, the rower can choose a seat position in a double, pair, quad, four, or eight, and choose whether the shell is coxed or not. In some cases, when a rower selects the context of rowing in a multi-person shell, the display could show the rower in a selected seat in a selected shell with real or virtual images of the other rowers in the shell. For example, as shown in FIG. 2, four rowing contexts 110, 111, 112, and 113 can be selected by a rower. The presentation of rowing scenery to the rower can be from a variety of perspectives, such as for example, a bird's eye view of the shell, the rower's seat position view, view from another seat position on the virtual shell that the rower is rowing, view from a coach shell travelling along side the virtual shell that the rower is rowing, view from the perspective of a coxswain on the virtual shell that the rower is rowing, or view from another shell that is being rowed near the virtual shell that the rower is rowing.

In the multi-rower rowing context, the rower's rowing machine and the shells or rowing machines of other rowers can, in some instances, exchange real-time performance data and video/audio via an internet connection between them directly, or via a rowing server. In some instances, the rower is able to see the performance data and/or video/audio of the one or more other rowers, and the resistance engine on the rower's rowing machine can vary its resistance as a function of actions taken by the one or other rowers. Microphones on the rowing machine could allow the rower to communicate with the rowers that are in the group rowing session. Alternatively, the rower and the other rower(s)' rowing sessions can be time-shifted such that no real-time information exchange between the rower and other rower(s) occurs. Instead, performance data and video of the other rower(s) can be stored in the rowing server and received by the local rower's rowing machine on demand. In this way, group rowing can be simulated without requiring all rowers to be rowing simultaneously. The multi-rower context allows head-to-head racing, multi-shell racing, multi-person shell rowing, multi-person shell racing, as well as ergometer racing, group coaching, and other group rowing scenarios.

In some cases, the multi-rower mode allows the rower to row cooperatively with one or more other rowers in a simulated multi-person shell. For example, in a cooperative rowing context where the other rower(s) are on the same virtual shells as the rower, increased shell acceleration due to the other rower(s) increased effort would temporarily decrease the resistance experienced by the rower during that stroke. Further, in some cases in the cooperative context, the video display can show the rower the rowing motion of the other rower(s) so that stroke synchronization can be achieved between the rower and the other rowers.

Figure 7:
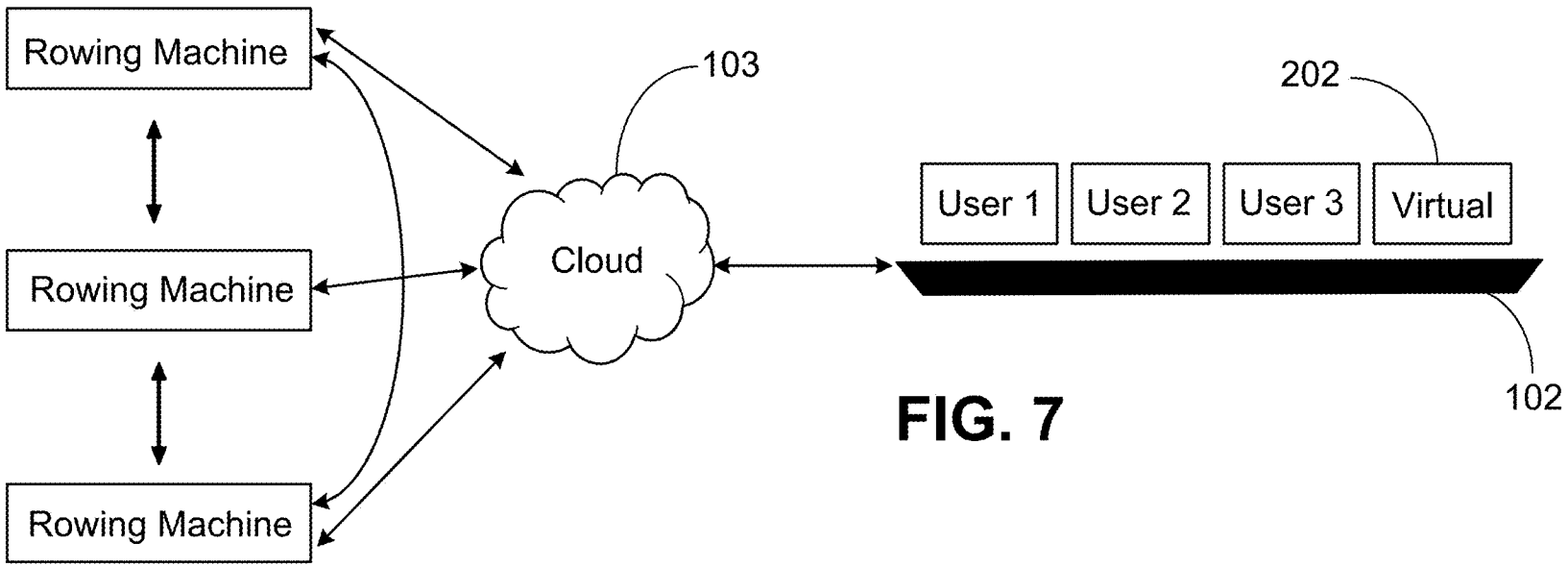

In some examples, a rower may choose to row with two friends who also have rowing machines and technology described here. In some instances, as shown in FIG. 7, these three rowers may choose to row in a coxed four 201. Instead of leaving the fourth seat in the shell empty, the rowing technology would synthesize a virtual fourth rower 202 and add the virtual rower to the virtual coxed four shell to the video displayed by the presentation device for each of the three rowers. The rowing technology could likewise synthesize a virtual coxswain to be displayed to each of the three rowers. The rowing technology described here could, for example, give the virtual fourth rower the physical performance of the average of the other three rowers, or any other physical performance level the at the three rowers choose. In general, the rowing technology described here can synthesize as many virtual rowers as necessary to fill the empty seats on a multi-person shell in order for the rower to row in a multi-person shell without "empty seats."

In some cases, the multi-rower mode allows the rower to row competitively against one or more other rowers in a simulated multi-person shell. For example, in a competitive rowing context where the rower is in a virtual shell that racing against one or more other virtual shells, the video display can show the information in the cooperative context for those in the same virtual shell as the rower, and show information in the competitive context for those in other virtual shells that are racing or competing against the virtual shell that the rower is on. In some cases, the competitive context is a single scull race against five other single sculls on a race course that has six lanes. In some cases, the competitive context could be a group session involving two or more shells on a course with two or more lanes. The shells in the competitive context could be single scull, double scull, pair, coxless four, quad, coxed four, and eight. The rowing technology described here can also simulate unconventional racing scenarios involving many more lanes than would be possible on a real-life rowing course, shells of different types and sizes racing against each other, and rowers of different gender, age, weight class, experience level, etc. racing against each other. In some instances, when the multi-rower competitive context is selected, the rowing technology described here can handicap the different rowers (by gender, age, weight class, experience level, etc.) and shells (types and sizes) to equalize the competitiveness between all the rowers and virtual rowers in the selected rowing context. In some instances, the rower's rowing machine would present to the rower video of the rower rowing in the competitive context, showing the progress of the other virtual shells.

Figure 8:
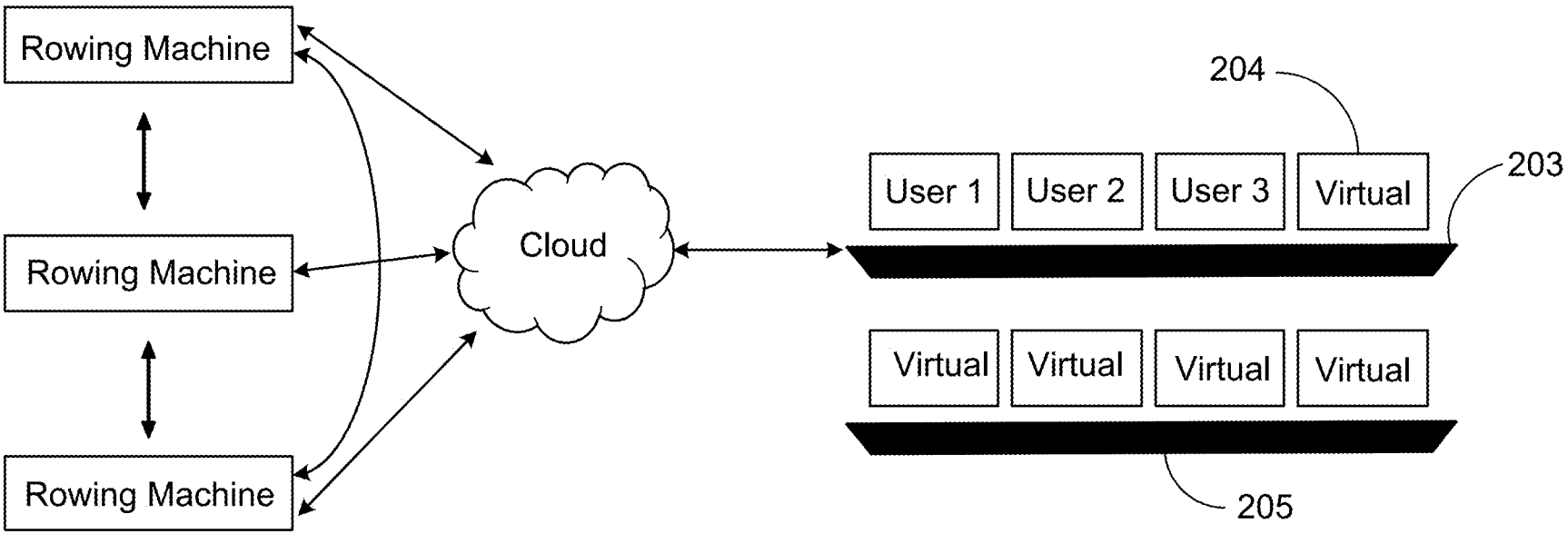
Figure 9:
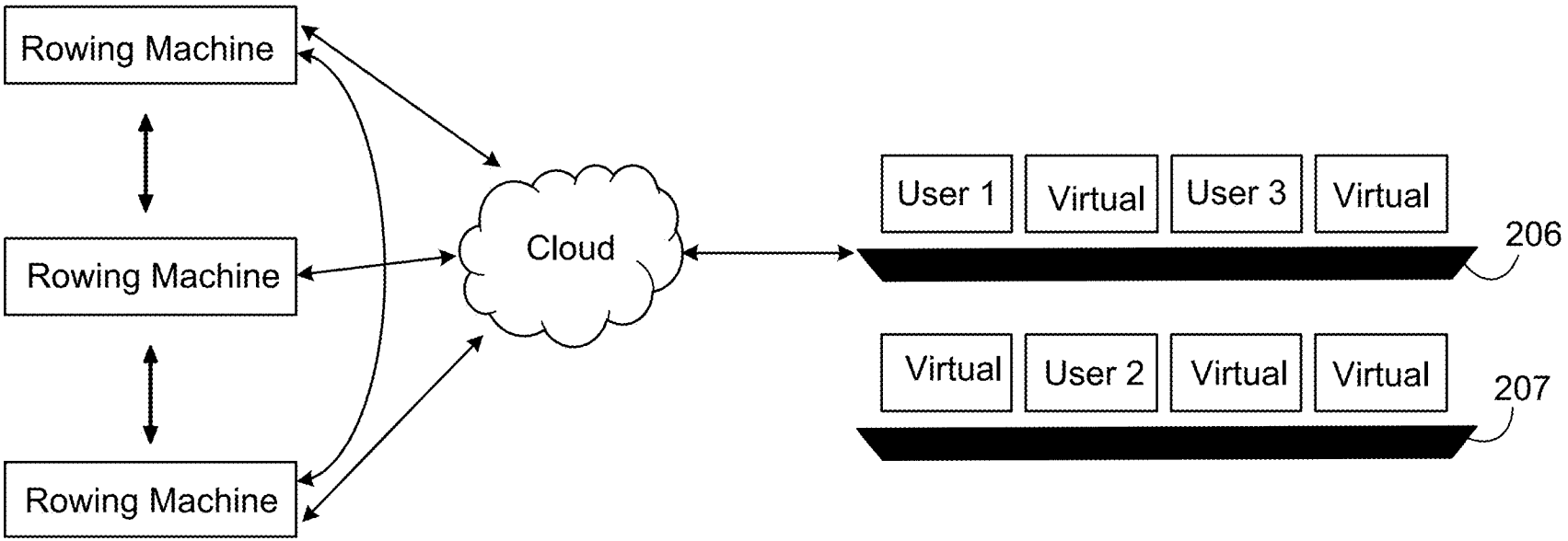

In some cases, a rower may choose to row with two friends who also have rowing machines and technology described here. In some instances, these three rowers may choose to row separately, each in a single scull, in a race having eight lanes. Instead of leaving the other lanes empty, the rowing technology would synthesize five virtual rowers in single sculls and add the five virtual rowers to single sculls in the other lanes and show the three rowers and five virtual rowers by the video display for each of the three rowers. The rowing technology described here could, for example, give the five virtual rowers the physical performance of the average of the other three rowers, or any other physical performance level the at the three rowers choose, such as, for example, performance of an Olympic team rower, a college rower, or an age group winning rower. In general, the rowing technology described here can synthesize as many virtual rowers as necessary to fill the empty lanes in a racing context. In some instances, the three rowers may choose to row together in a coxed four, as illustrated in FIG. 8, and race against another coxed four 203 in a two lane race. Under this rowing context, the rowing technology can, for example, synthesize a virtual fourth rower 204 to fill the empty seat in the coxed four, as described above. Additionally, the rowing technology can, for example, synthesize a virtual coxed four 205 to fill the other lanes in the race. In some instances, the rower can select the performance of the virtual shell to simulate any desired performance level, for example, the speed and stroke rate of Olympic level, college level, or club level shells. In general, the rowing technology described here can synthesize as many virtual rowers as necessary to fill the empty lanes as the rower desires in a multi-shell context. In some instances, the rower may select the option of leaving some lanes empty. In some instances, rowers in the example of FIG. 8 may choose to in two separate coxed fours as shown in FIG. 9. In FIG. 9, rowers 1 and 3 are rowing cooperatively in one coxed four 206 while rower 2 is rowing against rowers 1 and 3 in a separate coxed four 207. The rowing technology synthesizes virtual rowers to fill the empty seats in the to coxed fours 206 and 207.

Figure 10:
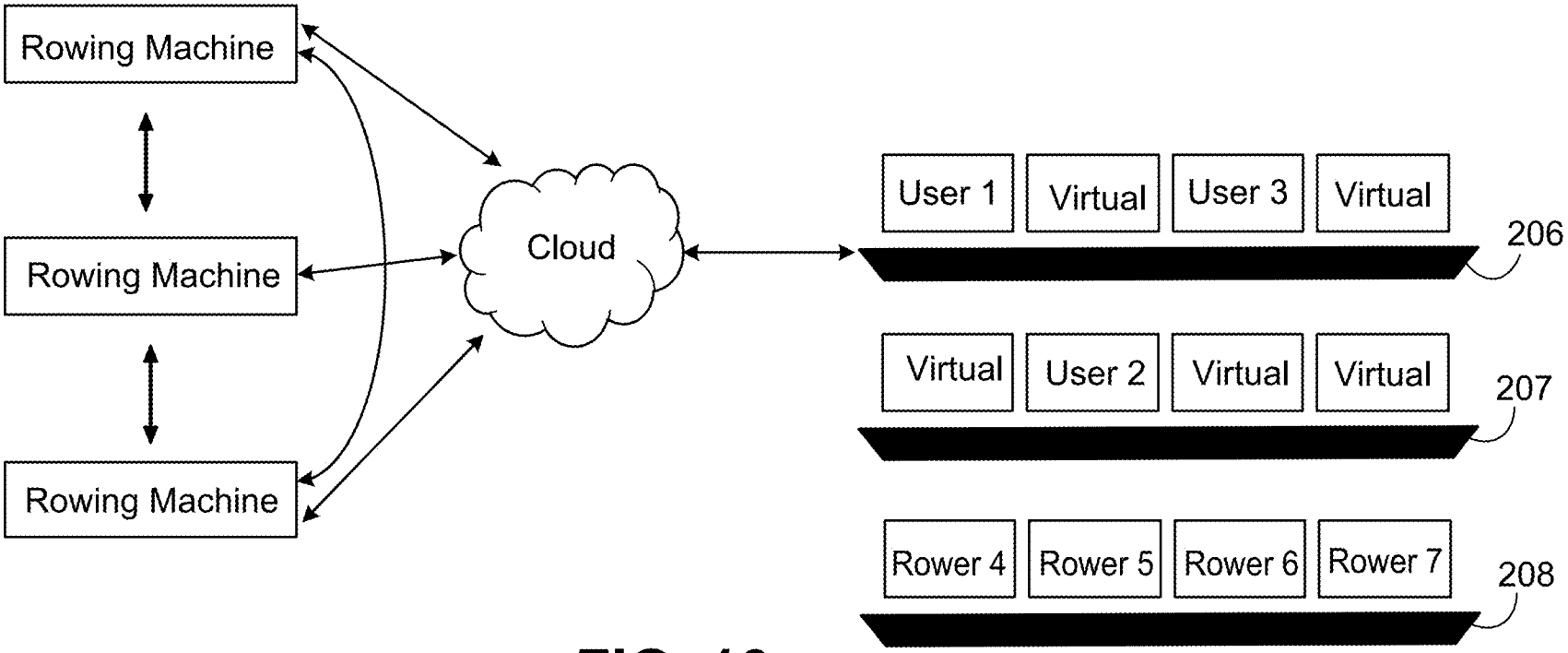

In an example of a rowing context that uses the rowing technology, a rowing group could include a rower and two friends rowing on three rowing machines and four other friends rowing in a coxed four on open water. Together the members of the group conduct a three-shell (coxed four) race, as shown in FIG. 10. In such rowing contexts, the rowing technology can, for example, include the coxed four 208 on open water, while the three rowers on the rowing machines adopt the configuration in the example shown in FIG. 9. To include it as part of the rowing technology, the pair shell on open water includes at least one video camera, at least one sensor (such as GPS unit) for measuring speed and direction (and in some cases for measuring stroke rate and other rowing data), and a wireless communication component, such as one that communicates on a cellular network such as 4G, LTE, or 5G with the rowing server. Live real-time video images and rowing data such as speed and direction of the pair shell on open water can be transmitted from the video camera and sensors on the pair shell to the rowing server. The rowing server relays the information to the three friends rowing on rowing machines. In some instances, those three friends can be split into two separate virtual pair shells 206, 207. In one of those pair virtual shells are two of the friends, and the second pair virtual shell has a single rower. The rowing technology synthesizes virtual rowers for the empty seats in the pair shells. As described above, the rowing motion and performance of each of the virtual rowers can be selected by the rower or rowers rowing on the machines. This rowing context therefore has three pairs racing against each other. The first pair is a real pair shell being rowed on open water. The second pair is a virtual pair shell being rowed by two rowers on rowing machines. The third pair is a virtual pair shell being rowed by one rower on a rowing machine and one virtual rower synthesized by the rowing technology.

The rowing technology can provide many other rowing contexts. For example, the number of rowers participating in a context presented by the rowing technology can vary according to the availability to the rowing server of connections to rowers and the number of rowers having rowing machines and rowing shells equipped to connect to the rowing server. The rowing contexts can include any number of rowers on rowing machines combined with any number of virtual rowers and real rowers in shells on water and the rowers can be combined in any number and types of real and virtual shell configurations. Thus, for example, the rower with two friends described above could row in an eight, coxless four, quad, double, or pairs instead of a coxed four, and can row against any number of other persons on rowing machines or in shells on water, as facilitated by the connections of participation devices of the rowers with the rowing server.

In some instances, in rowing contexts involving more than one rower, whether on rowing machines or in shells on water, the activities of the rowers on the rowing machines need not occur at the same time with respect to each other or with respect to the rowers in shells on water. In some cases, the rowing technology can use stored audio and video and rowing data to time-shift each rower's rowing experience to simulate simultaneous rowing when in fact the rowers are rowing at different times. By doing so, the rowing technology described here allow rowers to experience the social interaction of group rowing sessions for training or racing, without bringing all members of the group to one location or at the same time.

In some instances, when a rower logs into the rowing server, the rower can select from among many options for rowing sessions, rowing contexts, and rowing scenarios. The following table is an example of the layers of menus and functional activities presented by a rowing app and that the rower can choose from in the rower interface or receive through email.

| | |
|---|---|
| Funnel | Hear about app |
| | Download app |
| | Start App and Register |
| | Connect to machine |
| | Workout |
| | Subscribe |
| | Workout regularly |
| | Improve |
| | Use app at home and gym |
| | Water quality stewardship |
| | Invite a friend |
| | Build a crew |
| | Race |
| | Journey |
| Welcome | Splash screen |
| | Unpacking experience |
| Registration | Create an Account |
| | Registration-More info |
| | Sign In |
| | Forgot Password |
| Welcome/First Time Rower | Home |
| Connect | Detect machine and connect via Bluetooth |
| Subscriptions | Monthly |
| Welcome/Return Rower | Home |
| | Switch Profiles |
| | Log Out |
| | Forgot Password |
| Feed | Feed of activity from you (and your friends) |
| Workouts | First time welcome to workouts |
| | Featured/new Workouts |
| | Browse Workouts |
| | Free Workouts |
| | Premium Workouts |
| Preview Workout | Preview |
| Workout | Start a workout |
| | Countdown |
| | Resume workout |
| | Workout Stats-Full |
| | Leaderboard |

-continued

| | |
|---|---|
| | Workout Stats compact |
| | Workout Stats not connected |
| | Workout rewards |
| | Interruptions |
| | Resume a workout |
| | End a workout |
| | Workout Summary |
| | Done |
| Progress | Home/Dashboard |
| History | List of rows |
| | Past row details |
| Profile | Basics |
| | Goals/Demo |
| | Social accounts |
| | Log out |
| | Change Password |
| | Settings |
| Rewards | Show rewards |
| | Badges/Gaming |
| Other | Settings |
| | About the app |
| | TOS |
| | PP |
| Device access | Location |
| | Camera |
| | Pictures |
| | Microphone |
| | Contacts |
| | Calendar |
| | Bluetooth |
| | Offline (no network) |
| Push Notifications | paired to devices |
| Email | Welcome/Getting Started |
| | Upgrade |
| | On subscription |
| | Workout Report |
| | Weekly Activity Report |
| | Monthly Activty Report |
| | Tips |
| | Miss you |
| | Congrats |
| | Social-follower |
| | Social-joined group |
| | Social-challenge your friends |

The rowing server (which we also sometimes refer to as the "rowing cloud" or simply the "cloud") 103 includes a database that stores a variety of information, such as for example, shown in FIG. 4. Any of this information can also be stored in a controller or other participation device associated with a rowing machine or a shell. The information stored on the rowing server includes rower information and rowing scenario information.

In some embodiments, the rower information stored in the database of the rowing server includes a rower's personal identification and physical information such as name, rower account credentials (rower name and password or ID), age, gender, weight, height, maximum heart rate, heart rate at each training zone, and the rower's preferences for specific rowing scenarios. A wide variety of other personal information can also be stored.

In some cases, the rower information can be communicated to a participation device of a rower and used by the controller of the rower's rowing machine to adjust the resistance profile of the resistance engine, thus tailoring the rowing experience to that rower. For example, for a given rowing scenario, the controller can instruct the resistance engine to provide lower resistance or a lower resistance profile to a lighter rower than to a heavier rower.

In some instances, if a rower selects a rowing scenario that includes a target heart rate zone for the rowing session, the controller can cause the resistance engine to decrease the resistance when the rower's heart rate exceeds the desired zone and to increase the resistance when the heart rate falls below the desired zone.

In some cases, a rower can select a rowing scenario to race against another rower of a different age and gender. The controller can cause the resistance engine to adjust the resistance to normalize it to handicap the differences in age and gender. Using this capability, an Olympic-level female rower for example, can compete head-to-head virtually against an Olympic-level male rower and see their virtual shells on screen racing closely. Similarly, a sixty year old masters rower for example, can compete head-to-head virtually against his twenty year old college daughter, and would be able to watch the virtual shells compete closely on screen, presuming that they have similar rowing fitness levels relative to their age and gender group.

In some embodiments, the rowing scenario information can include the type of shell, rigging, oar, water condition, seat position in a multi-person shell, and type of rowing machine, among other things. Variations in each of the characteristics—shell, rigging, oar, water condition, seat position in a multi-person shell, and type of rowing machine—individually and in combinations correspond to different resistance profiles and characteristics. Examples are presented below.

The resistance profile that a rower experiences in a single scull is different from resistance profile experienced by the rower in a coxed eight, with the eight being heavier and harder to accelerate from a stand-still. Thus, if a rower selects an eight as the shell of choice for a rowing context, the controller can cause the resistance engine to impose a higher resistance or resistance profile during the first few strokes to mimic the forces needed to overcome the large inertia of an eight at startup.

In choppy water, a rower can experience uneven resistance as he or she pulls the oar through the power stroke, because some portion of the blade may not be fully immersed. Thus, if the rower selects a rough water context, the control can cause the resistance engine to vary the resistance to simulate choppy water.

In a multi-person shell, if the rower's stroke rate starts to fall behind the stroke rate of the other rowers in the shell, the resistance experienced by that rower would decrease. If the rower selects a multi-rower shell context, and the rower's stroke rate lags the stroke rates of the other rowers in the shell, the control can cause the resistance engine to reduce the resistance or resistance profile. This brief easing of resistance can allow the rower to recover and resume the earlier stroke rate that is synchronized with the other rowers.

In some embodiments, the rowing scenario includes video clips of rowing locations, e.g., bodies of water for rowing, including views from different perspectives of the shell on water and background scenery.

In some cases, each video clip would involve a rowing session of a certain duration, 5 minutes, 10 minutes, 20 minutes, 30 minutes, 45 minutes, 60 minutes, for example, or 1 km, 2 km, 3, km, 4 km, 5 km, for example. For example, a video clip can show a shell being rowed at 25 strokes per minute at two minutes per 500 meters for 5 km down river on the Charles River. The video can show this shell from the perspective of the rower's view, with the video captured by a camera mounted on the rower's body or head facing forward. Another video clip can, for example, show the same shell being rowed over the same course at the same stroke rate and speed, but with the rower's body camera facing backwards. A third video clip can show the same shell being rowed over the same course at the same stroke rate and speed, but from a bird's eye perspective captured from a overhead flying drone. A fourth video can show the same shell being rowed over the same course at the same stroke rate and speed, but from a side view captured from a shell travelling next to the shell being rowed. A fifth video clip can show the same shell being rowed over the same course at the same stroke rate and speed, but with a different frontal view captured by a camera mounted near the bow of the shell. A sixth video clip can show the same shell being rowed over the same course at the same stroke rate and speed, but with a different rear view captured by a camera mounted near the stern of the shell. These six video clips can, for example, be bundled or synchronized such that a rower can toggle among the different video perspectives while rowing on the rowing machine.

In some examples, a set of video clips can show a multi-person shell. In such examples, there can be sets of video clips for rowers' perspectives for all seat positions. For example, a video for a rower in the number three seat in an eight would show the backs of five rowers, in seat positions four, five, six, seven, and stroke. A rower in the number six seat in the same eight rowing over the same course would only show the backs of two rowers, in seat positions seven, and stroke.

In some implementations, the video clips of rowing that are stored in the database on the rowing server can be filmed at many rowing locations throughout the world, capturing many types of shells including singles, doubles, pairs, fours, quads, eights, coxed or coxless, and sculls and sweeps. Locations can include Olympic racing venues, regatta venues, training facilities, or any other bodies of water suitable for rowing shells. The video clips can capture the shell traveling on variations of courses at a given location, such as, for example, up river and down river. The video clips can be captured at different times of the year to provide a selection of different weather and water conditions, and different views of the background scenery (e.g. greenery versus fall foliage). Thus a library of video clips can be, for example, located in the rowing server such that a rower on the rowing machine can select, for example, to row in seat number three of a quad on a sunny spring day up river on the Charles River in Boston. The rower can also select a birds-eye view of the rowing experience.

In some embodiments, the video clips of rowing on water are accompanied by or associated with or have embedded or synchronized rowing data for the scenes of the clips. The rowing data can include, for example, one or more of stroke rate, shell speed, estimated power from each rower in the video, or stroke length.

The participation device can use this rowing data to synchronize the video playback with the rower's rowing motion on the rowing machine. Examples include the following.

If the video as originally recorded shows a shell traveling at 2 minutes per 500 m, and the rower on the rowing machine is rowing at a virtual shell speed of one minute 55 seconds per 500 m, then the participation device would speed up the video so that the speed of the shell in the video matches the virtual speed of the rower on the rowing machine.

If the video as originally recorded shows a rower in a shell on water rowing at 25 strokes per minute, and the rower on the rowing machine is rowing at a stroke rate of 20 strokes per minute, then the participation device would slow down the video to synchronize the stroke rate shown in the video with the stroke rate of the rower on the rowing machine.

When there is a disparity in rowing speeds or stroke rates, the presentation device can display to the rower as text or graphical elements the difference between the rower's speed or stroke rate and the speed or stroke rate of a rower in the video. The presentation device can, for example, provide coaching advice to the rower of the rowing machine to speed up or slow down to match the speed and stroke rate of the rower in the video.

In some cases, a rower can access the rowing server using an app or web portal through the participation device. In some cases, once a rower logs into an account, the rower's personal identification and physical information would be made accessible to the rower through the participation device. The rower can (in some implementations only after having logged in) access the rowing scenario information representing the video clips in the library of rowing video clips stored in the database at the server. The rower can, for example, select rowing contexts for the rowing session. The rowing server can restrict rower access to only a certain portion of the video clip library, e.g., only certain scenarios and contexts, such as types of shells or rowing locations, based on the rower's account payment status and preferences, among other factors. In some instances, the rowing server can enable rower access to video clips on a pay-per-video-clip basis, a monthly payment basis, or a minutes-limited package, among other payment arrangements.

In some embodiments, the video clips of rowing stored in the rowing server can be processed to segregate background scenery from foreground shell movement, oar movement, and/or water ripples, wake and splashing. The segregated video components can be recombined with video components from other video clips to create composite video clips. For example, a first original video clip can show a double rowing up river on the Charles River in Boston. A second original video clip can show a quad rowing down river in St. Catharines, Canada. A recombination of components from these two video clips could show one composite video of a quad rowing up river on the Charles River in Boston, and a second composite video showing a double rowing down river in St. Catharines, Canada. These composite video clips would be stored in the rowing server. By processing the original video clips to make composite video clips, and storing the composite video clips in the library on the rowing server, the total number of video clips and thus different rowing scenarios and contexts can be dramatically increased.

In some instances, the video clips of rowing stored in the database of the rowing server can be processed to add overlays of images of other shells, rowers, or a coach on a skiff, among other possible overlays. The overlay processing can be performed in advance with the video containing the overlay stored in the rowing server. In some cases, the overlay processing can also occur on the participation device of the rower after the rower selects a particular video rowing scenario and inputs preferences such as whether an image of a virtual coach is desired.

The rower, among one or more rowers in a video clip, can be the rower of the rowing machine. In this way, the rower can record video clips of rowing on water, and then use those video clips in training on a rowing machine or for other purposes.

Figure 5:
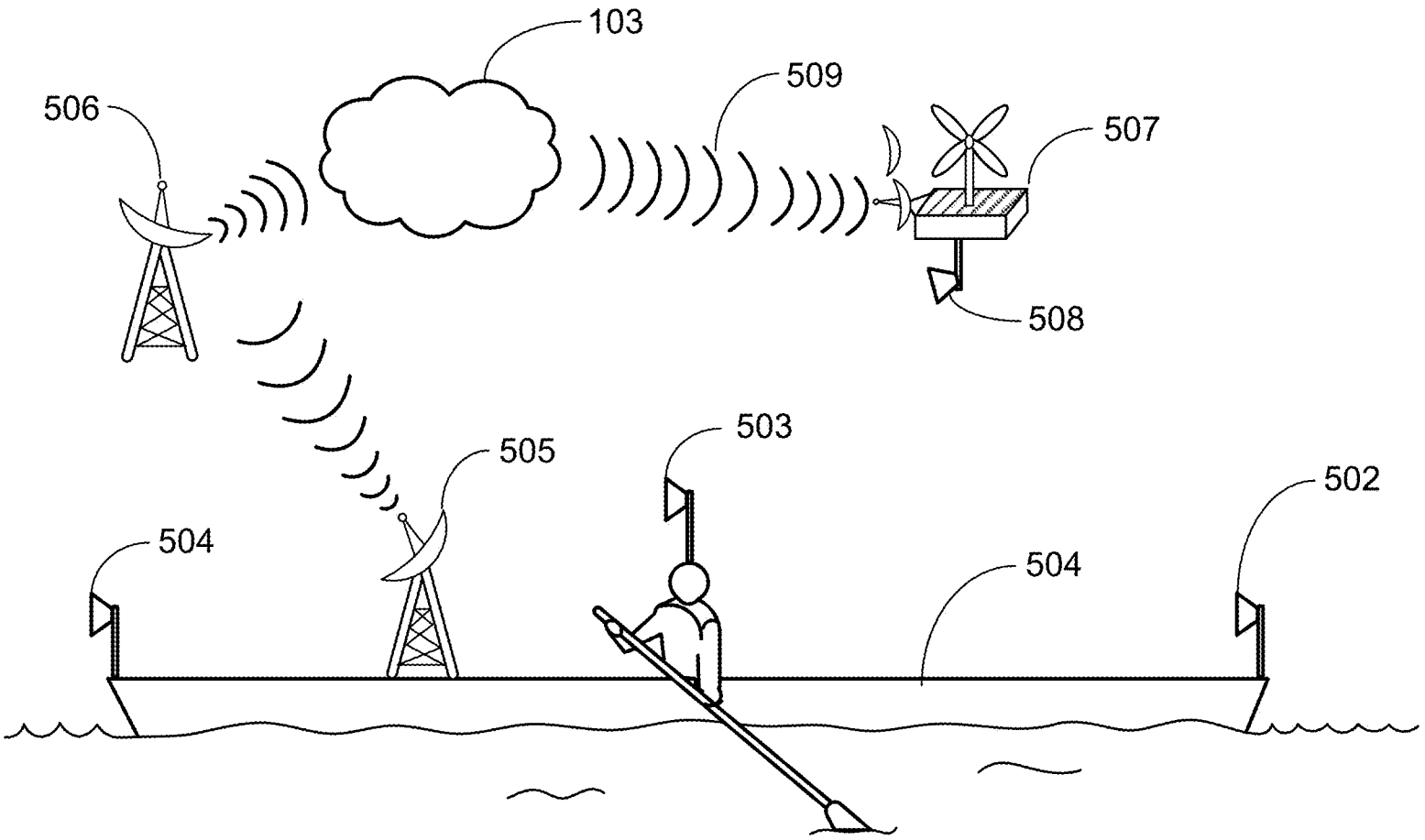
FIG. 5 is a schematic view of a shell being rowed.

In some embodiments, the video clips in the database on the rowing server can be captured by cameras mounted on one or more of: shells rowing on water, cameras mounted on the body or head of the rowers rowing on water, cameras mounted on flying drones, or cameras mounted on shells such as power shells that follow the moving shell on water. For example, as shown in FIG. 5, cameras 501, 502, 503, and 508 capture video of the shell 504 being rowed on water. A rower on the rowing machine can choose one or more views among the available views produced by the different camera angles and camera mounting locations for presentation during a rowing session. The different camera angles and camera mounting locations allow, for example, the rower to analyze the rowing motion of the rower in the video clips, and mimic (or avoid mimicking) the rowing motion of the rower in the video clips.

In some instances, the video clips in the database of the rowing server can be captured by one or more cameras mounted on or in the vicinity of another rowing machine instead of in a shell. The rower of a rowing machine can watch the video clips to observe the technique of the rowing motion of the rower on the other rowing machine. In some instances, the remote rowing machine is being rowed by another rower that the first rower wants to interact with socially in a group rowing session, whether for training, coaching, recreation, or racing.

In some implementations, the video clips of rowing either in a shell on water or on a rowing machine can be filmed, communicated to the rowing server, and then communicated in real-time from the rowing server to the participation device on the rowing machine for display to the rower. A real-time relay of video clips would be desirable for racing or live group rowing scenarios. In some cases, when the real-time video is of a rowing shell on water equipped with a communication device such as cellular capability for transmitting data, the video shot from the shell can be transmitted in real-time directly to the participation device of the rower without the rowing server performing as an intermediary. In some instances, real-time video clips can be captured at two different rowing machines and exchanged in real time to enhance the real-time social aspect of the rowing experience.

Figure 11:
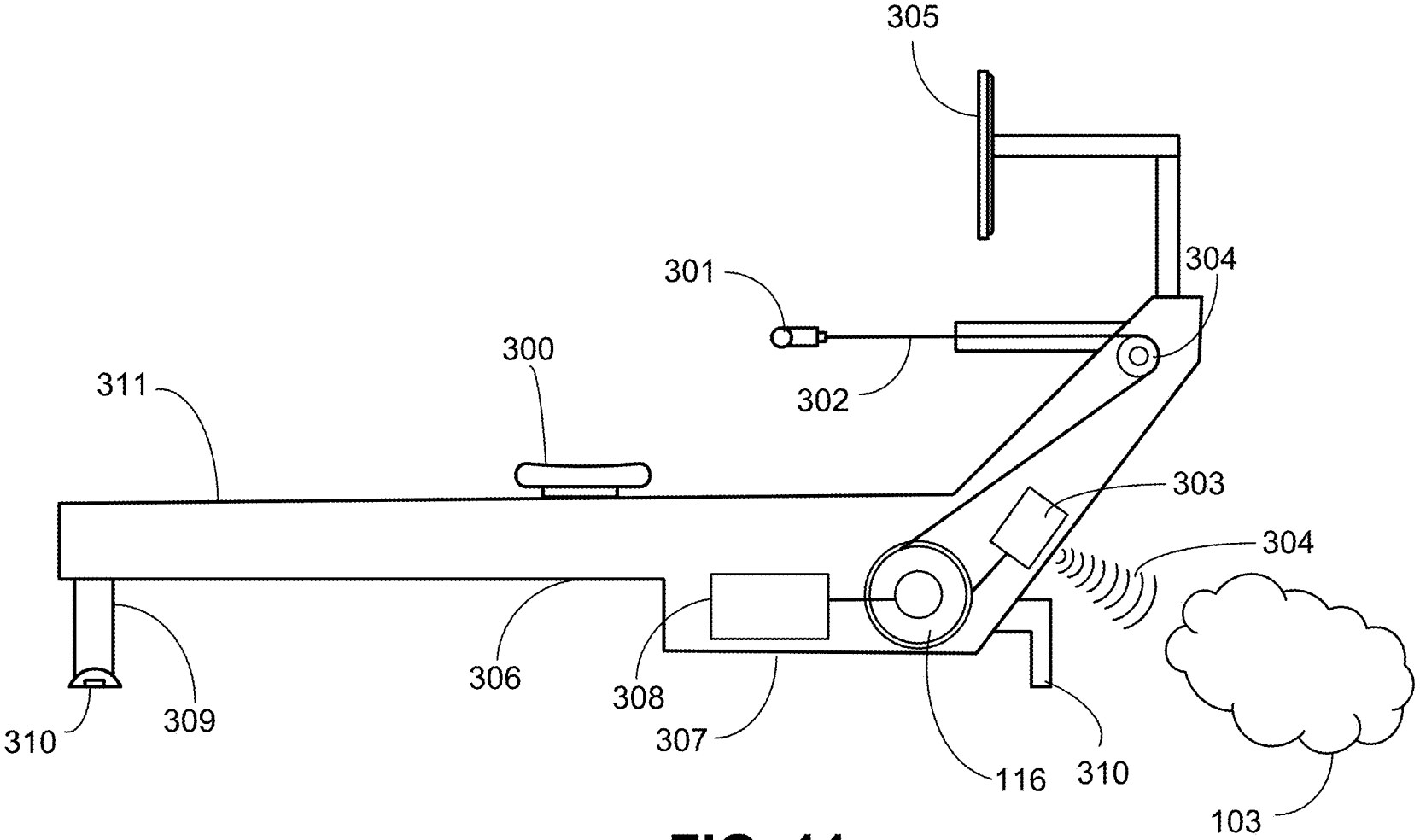
FIGS. 11, 12, 13, 14, 15, 16 are respectively side, perspective, side/perspective, perspective, perspective, and top views of rowing machines.

In general, as shown in FIG. 11, at least some of the rowing machines used in the rowing technology have a seat 300, a handle 301, a resistance engine 116 to provide resistance against a cable 302 being pulled by the rower using the handle 301, a controller (which can be implemented as a computer) 303 to control the resistance engine and provide network connection 304 to the rowing server 103, and a participation device including a rower interface having a display.

The rowing machine uses a quiet electromagnetic-based resistance engine to emulate resistance profiles in a wide variety of rowing scenarios and rowing contexts, such as of oar strokes in live rowing on water. The resistance engine can run quietly because it does not rely substantially on air resistance to provide resistance to the rower. Creating resistance by spinning a fan in air generates noise. Instead, the resistance engine uses an eddy current brake, a motor-generator, a motor, a generator, or a combination of those devices to create resistance to the rower's rowing motion.

In some embodiments, a controller controls the resistance engine to adjust the resistance profile of the rowing machine based on input from the rower, input from one or more sensors on the rowing machine, and in some instances data received from a rowing server. In some cases, the controller can adjust the resistance provided by the resistance engine based on input from rowing data embedded in or otherwise associated with the video clip. The participation device can synchronize the speed of the video clip playback to the rowing motion of the rower on the rowing machine. A rower control interface can be presented to the rower on the participation device to allow the rower to provide input to the controller, store personal and physiological data, and access the rowing video library stored in the database of the rowing server. Rowing machines can be linked together virtually through the rowing server to simulate racing or to simulate rowing on a multi-person shell.

In some cases, as mentioned earlier, the rowing machine includes a participation device that provides a rowing interface including a display for presenting video clips of one or more shells being rowed on water. The video clips can be pre-recorded and stored locally or remotely. The video clips can also be delivered by live video feed from a participation device of another rower on a second rowing machine or of another rower rowing on water. In some instances, the controller can vary the resistance profile of the resistance engine by factoring in rowing data (such as speed of the shell and stroke rate) associated with the video clip.

Figure 12:
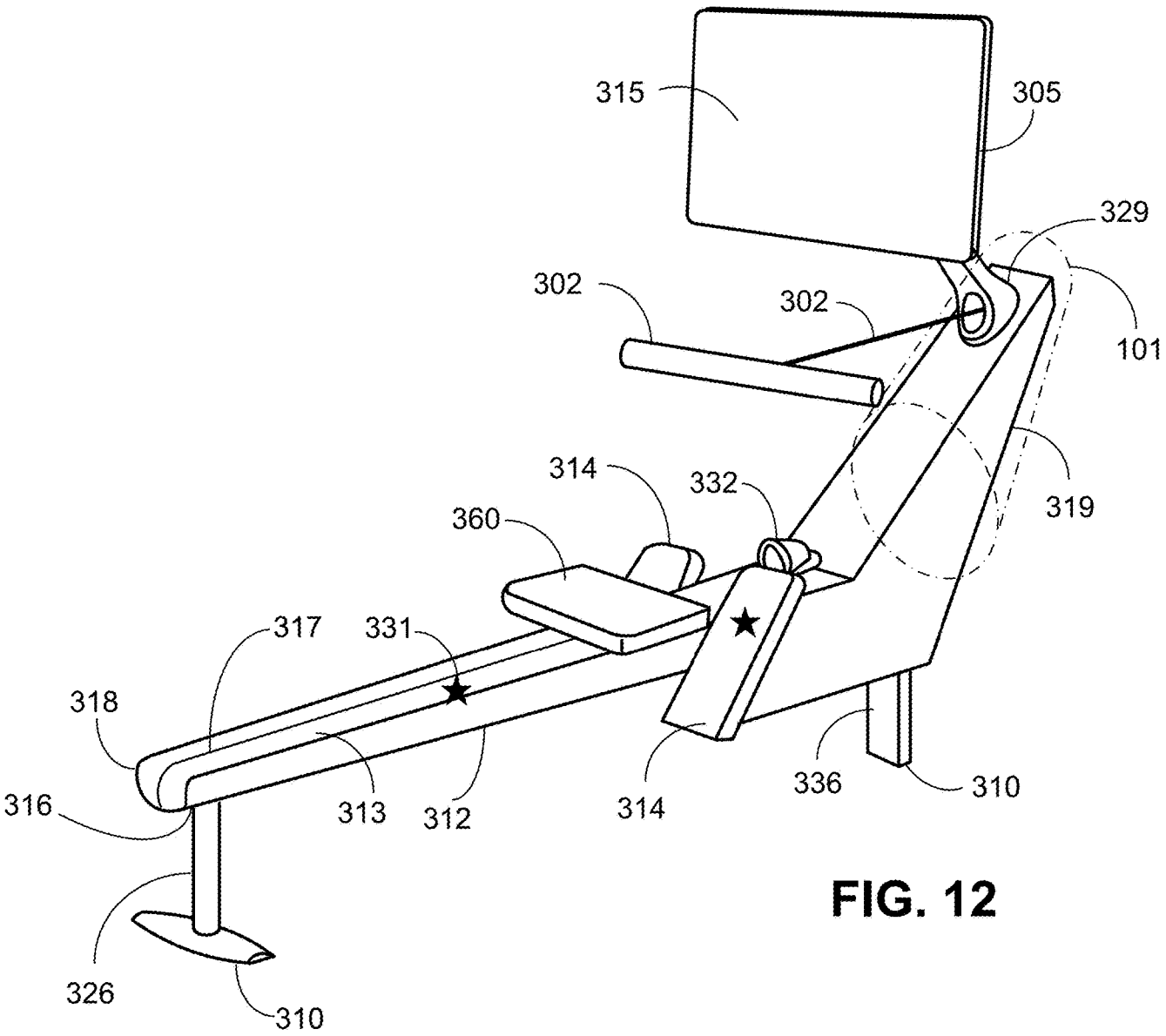

As shown in FIGS. 11 and 12, in some implementations, the rowing machine 101 has a chassis 312, a rail 313, a seat 300, a resistance engine 116, a controller 303 that controls the resistance engine, a handle 301, a cable 302, a footrest 314, a participation device providing a rower interface 315 and an audio-visual presentation component 305. In some examples, the chassis 312 includes a platform 316 having a structure that allows the rowing machine 101 to sit stably on a floor. The chassis 312 supports a rail 313. The rail 313 includes a longitudinal member 317 on which a seat 300 is mounted to be slidable forward and backward along the rail 313. Near one end 319 of the chassis 312 is a handle 301 shown in a retracted position as when the rowing machine is not in use. The handle 301 is connected to a cable 302. The other end of the cable 302 is connected to the resistance engine 116 that provides resistance against the rower pulling the handle away from its retracted position in the direction toward the opposite end 318 of the chassis 312. The resistance engine 116 is mounted on the chassis 312 near the retracted position of the handle 301. A footrest 314 is mounted on the chassis 312 near the retracted position of the handle 301. The relative position of the footrest 314 and the retracted position of the handle 301 are determined by the body geometry of the rower (and can be adjusted to suit that body geometry) and are configured to enable a rowing motion by the rower as if the handle corresponded to the handle end of an oar, the foot rest corresponded to a footrest in a shell, and the sliding seat corresponded to the sliding seat in a shell.

The electronic controller 303 that controls the resistance engine 116 is mounted on the chassis 312. The rower interface 315 that allows the rower to select a resistance profile, interact with the rower account and the rowing server, and control functions of the controller 303 can be mounted on the chassis 312 near the retracted position of the handle 301. The audio-visual presentation device 305 (which is one kind of presentation device) is generally mounted on the chassis 312 near the retracted position of the handle 301 so that when a rower is at the catch (the position of the rower and oar handle at the moment between the end of the recovery phase and the beginning of the drive phase of a rowing stroke), the rower's face is at a distance from the audio-visual presentation device 305 appropriate for viewing the displayed information.

The chassis 312 can be configured in various ways so long as it can stably support the other components of the rowing machine 101 when a rower is on the seat 300 and performing the rowing motion. As shown in FIG. 12, in some cases, the chassis 312 provides a mounting location for a rail 313 that is horizontal or near horizontal, to within a few degrees such that the rower of the rowing machine would not likely notice a deviation from horizontal while rowing on the rowing machine 101. In some cases, the rail 303 may be mounted deliberately to deviate from horizontal by up to 45 degrees so the rower can exercise different muscle groups and achieve neuromuscular adaptations different from typical rowing where the seat slides in a generally horizontal direction. The chassis 312 can be integrated with a rail 313 such that the rail 313 forms part of the structural connection between the ground contact points 310.

The chassis 312 can be made of one or more of: wood, stainless steel, steel alloys, aluminum alloys, titanium alloys, plastic, composite plastic, fiberglass reinforced resin materials, carbon fiber composites, and various combinations of these materials. Different portions of the chassis can be fabricated from different materials. For example, the highest load section 320 of the chassis can be made from steel while the housings of the rower interface and audio-visual presentation device support member 321 can be made from lightweight aluminum alloy.

The chassis 312 has sufficient bending and torsional strength to avoid plastic deformation when a rower of the rowing machine is applying up to 1000 N of force to the handle up to 60 times per second continuously. The chassis has sufficient bending and torsional strength to avoid substantial elastic deformation when a rower is applying up to 1000 N of force to the handle up to 60 times per second continuously. In particular, the portion 321 of the chassis and rail (or of the integrated chassis/rail structure) between the foot rest 314 and the engagement point 322 of the resistance engine 116, is subjected to the most bending and torsional force during use of the rowing machine 101. This portion of the chassis and/or rail can have an enlarged cross-sectional area 332.

Figure 13:
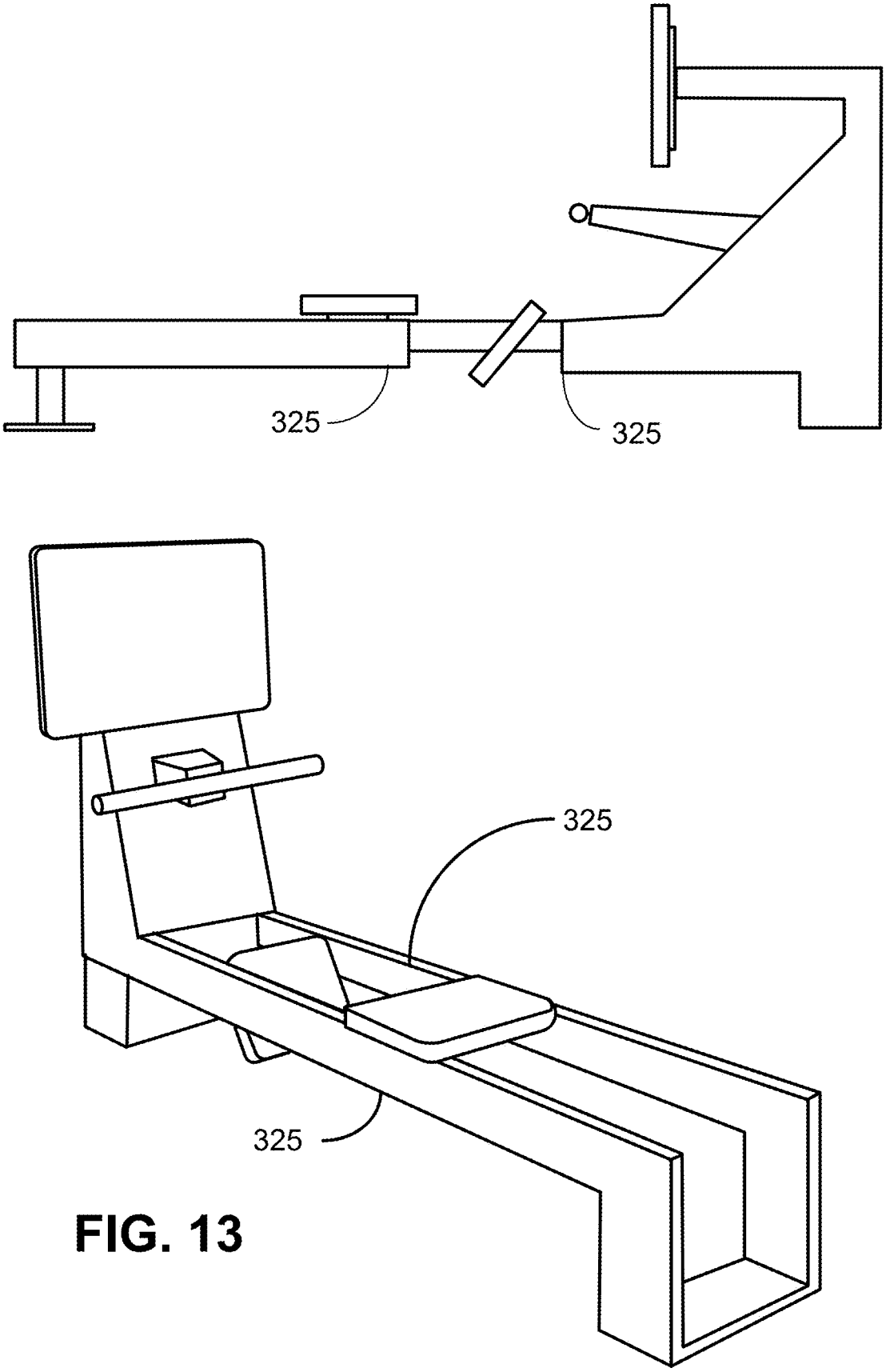

The chassis 312, including the rail 313 if a rail 313 is integrated with the chassis 312, can be formed into hollow shapes that increase the bending and torsional rigidity of the chassis 312, particularly the portion 321 of the chassis and/or rail subjected to high bending or torsional forces, i.e., high stress areas. For example, a larger cross-sectional area of a tubular or quasi-tubular chassis member 324 would provide higher bending strength at a given wall thickness than a member with smaller cross sectional area. The cross-section of the chassis member 324 includes an empty volume 306 into which various components of the rowing machine 101 can be fitted. In some cases, the cross sectional area 332 of the chassis member 324 can vary along the length of the chassis 312 such that higher strength segments coincide with the segments 321 that will experience higher bending or torsional stress. In some case, the shape of the chassis member cross section is optimized using finite element analysis to create a high strength to weight ratio member. In some examples, the chassis member's cross sectional shape at the high stress areas is a circle, an oval, an ovoid, a trapezoid, a triangle, a square, a rectangle, a star, or a complex shape. In some cases, structural members 325, such as for example, two or three tubes as shown in FIG. 13 can, in combination, provide appropriate bending and torsional strength to the chassis. In some cases, reinforcing materials (e.g. carbon fiber, steel, etc.) and structures (ribs, mesh, metal matrix fibers, etc.) are added to the high stress areas to increase bending and torsional strength.

There are many advantages to having hollow chassis and/or rail members. In some examples, various components of the rowing machine, such as the resistance engine, the power supply, the controller, the participation device, an Internet communication device, springs, bungee cords, chains, etc. can be located inside the volume of the chassis member, in an integrated hollow space. By packaging components inside the chassis, the rowing machine is not cluttered physically or visually by external components. Packaging components inside the chassis increases both aesthetic appeal and ease of storage of the rowing machine.

In some instances, integrating a resistance engine internally in the chassis allows the rowing machine to be more compact than if the resistance engine were external to the chassis. In a rowing machine that uses an air fan as a resistance engine to generate resistance against the rower's rowing motion, the air fan is not typically enclosed inside a chassis member because it needs an air supply to generate resistance. In some cases, the use of electromagnetic resistance engines as described here allows the resistance engine to be enclosed inside a chassis hollow member. Another advantage of fitting components inside a chassis member instead of mounting them outside is that no separate enclosure is necessary for enclosing certain components, such as a power supply, electromagnetic braking components, and spinning parts of the resistance engine, that could hurt the rower if left exposed.

To achieve stability when a rower is using the rowing machine, in some cases, the chassis has a low center of gravity. In some cases, a lower center of gravity can be achieved by locating more materials of higher weight density (e.g., steel alloys) in the lower portions of the chassis, and materials of lower weight density (e.g., aluminum alloys) in the higher portions. In some cases, a lower center of gravity of the chassis can be achieved by adding weight to the lower portions of the chassis, such as for example, by adding iron weights to the chassis near the points of contact with the ground or floor.

In some embodiments, the chassis can have one, two, three, four, five, six, seven, eight, or more points of contact with the ground or floor. The size and shape of each of the ground contacts and the spacing between the ground contacts would depend on the number of contacts as well as the surface on which the rowing machine is expected to be used. For example, as shown in FIG. 11, there are two ground contact points 310. For example, as shown in FIG. 12, there are two ground contact points 310. In general, more ground contact points, larger ground contact area, and more widely spaced ground contact points, are useful when the surface is softer, such as grass or carpet, or when the surface is uneven, such as a dirt parking lot. Fewer ground contact points, smaller ground contact area, or more closely spaced ground contact points, are necessary for stability when the ground or floor is smoother and harder, such as a cement slab floor.

Each of the points of contact can be at the end of a leg 326. Each leg 326 can be an extension of the chassis 312. The legs can be detachable from the rowing machine. Each of the points of contact can be adjustable so that the rail 313 on which the slidable seat 300 is located is horizontal or nearly horizontal. For example, when the chassis 312 has two or more legs, the length of one or more of the legs can be made adjustable to achieve a stable structure for the rail 313. The legs 326 can contain one or more of: springs, lockable shocks, or adjustable pistons to allow the chassis to be self-leveling so that the rail 313 is in a horizontal or near horizontal position when the rowing machine is placed on an uneven or sloped surface. The rail 313 can have a bubble level, laser level, or other level measuring device located along its length to aid the rower in achieving a relatively horizontal rail when adjusting the legs 325 of the rowing machine 101 during setup.

Figure 14:
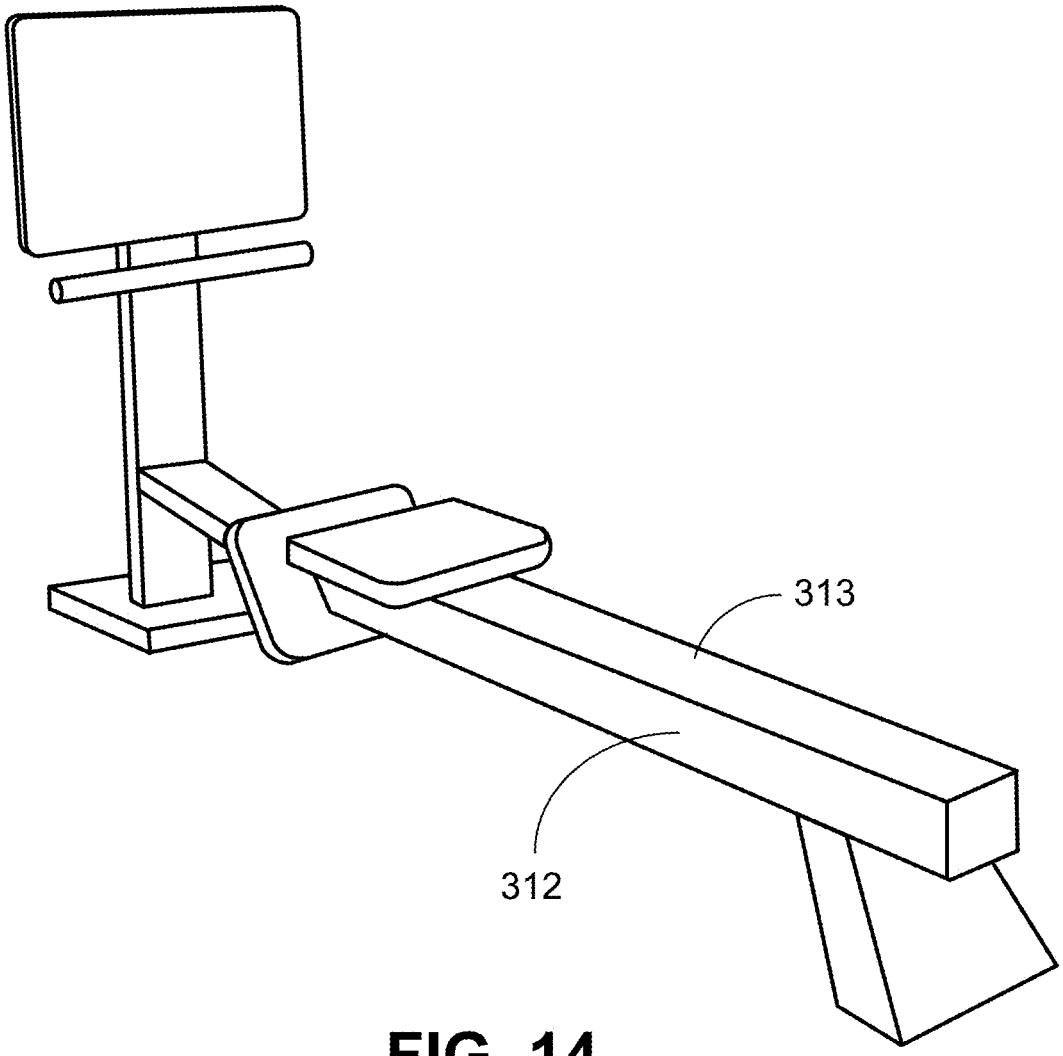
Figure 15:
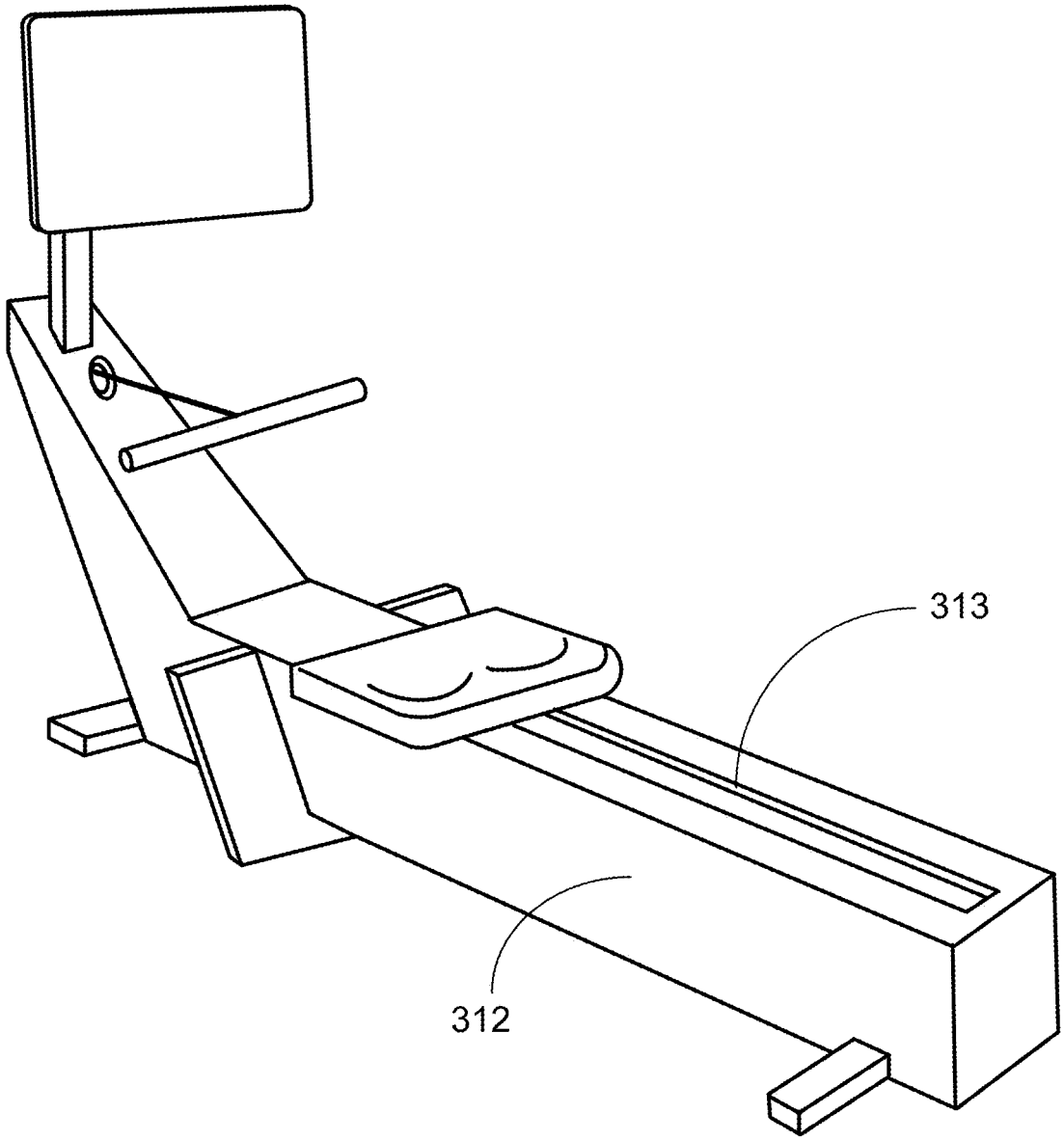

The chassis 312 can include one or more mounting points for a rail 313, as shown in the example in FIG. 14. The rail 313 can also be a structural member of the chassis 312 with the rail 313 providing the structural connection between two or more ground contact points or legs, as illustrated in FIG. 15.

The chassis 312 can include one or more mounting points for a resistance engine 116. The chassis also includes one or more mounting points for a resistance engine enclosure 327, as shown, for example, in FIG. 12. In some cases, the chassis 312 can include a housing section that forms an integrated hollow space 306 that can enclose a resistance engine 116. Thus, in some embodiments, the chassis 312 can have an integrated hollow space 306 that functions as a resistance engine enclosure 327. In some cases, the chassis has sufficient space within its body to enclose a cable that connects the handle and the resistance engine when the handle is in the retracted position. In some cases, the enclosure can be complete so that no portion of the resistance engine 116 is exposed. In some cases, the enclosure can be partial so that only moving portions of the resistance engine, or other portions that can present a danger to a rower (e.g., can cut, slice, or burn the rower if touched) is enclosed. The enclosure 327, or the portion of the chassis 312 that is configured to function as an enclosure 327 can be configured to provide ventilation to the resistance engine to dissipate heat from the resistance engine 116. In some examples, the resistance engine is more compact than a resistance engine that relies on an air fan or a water paddle to generate resistance.

Each of the rotating parts of the electromagnetic brake or fly wheel of the resistance engine can be, for example, no more than 3 to 24 inches at its largest diameter. As shown in the example in FIGS. 11 and 12, the resistance engine fits inside an integrated hollow space within a chassis of the rowing machine. In some cases, the resistance engine is securely bolted or attached to the chassis such that the rowing motion of the rower pulling on the handle attached to a cable that is attached to the resistance engine does not cause the resistance engine to move relative to the chassis.

In some instances, unlike in a typical conventional rowing machine for which the resistance engine is located in front of the rower's hand position at the catch position or where the handle is in a fully retracted position, the resistance engine of the rowing machine described here can, in some instances, be located anywhere along the length of the chassis or rail in either an integrated hollow section of the chassis or in an enclosure mounted on the chassis. In some cases, the resistance engine is narrower than 2-6 inches, making it sufficiently narrow to fit in the section of the chassis or rail between the rower's feet. In some cases, the resistance engine can fit entirely beneath the rower in a portion of the chassis or rail that supports a slidable seat 300. In some cases, the resistance engine can fit in a portion of the chassis or rail member that is in front of the rower in the catch position.

The chassis 100 can include other mounting points. For example, when the rail 313 is a member of the chassis 312, the chassis 312 at the rail 313 member would include a mounting mechanism for a slideable seat 300. The chassis can include mounting points for a rower interface device 315 or presentation device 305 or other participation devices, footrests 314, and various kinds of sensors 328, 329, 330, as described below, positioned throughout the rowing machine. The chassis 312 can include a mount for a fan near one end 318 or the other end 319 of the chassis 312 for cooling the rower. The chassis 312 can include a mount for a fan inside the enclosure 327 for cooling the resistance engine. The chassis 312 can include a mount for retaining the handle when it is near the fully retracted position. The chassis 312 can include mounts for a display cradle 189, an interface controller 191, a participation device cradle, a cradle 193 for an interface controller, a water bottle cage 195, a towel hanger 197, or other accessories that would enhance the rower experience while rowing on the rowing machine.

Figure 16:
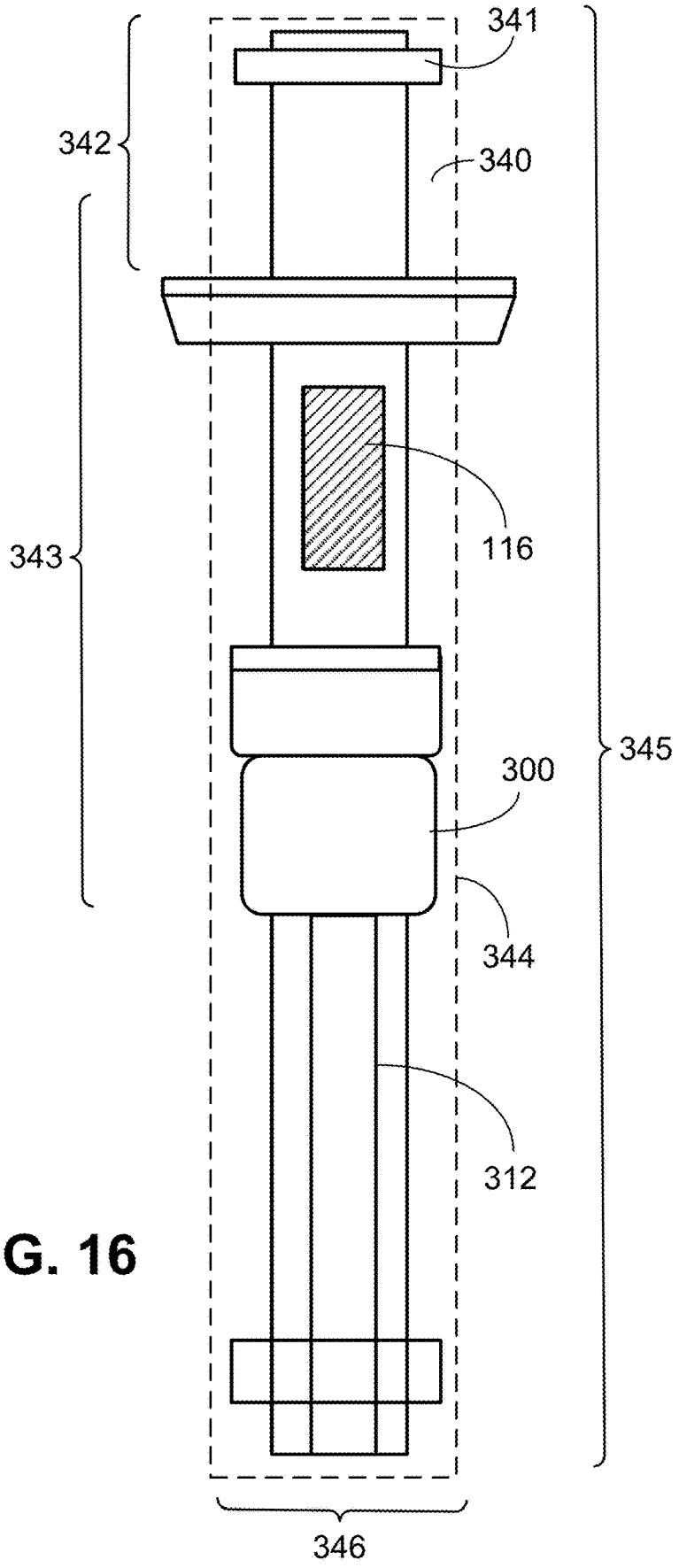

As shown in FIG. 16, in some implementations, the chassis 312 is designed to provide a smaller footprint (e.g., less than 15 square feet and as small as a rectangular area of 14.4 square feet) of the rowing machine when configured for rowing than a typical rowing machine that uses an air fan or water paddle for resistance. In the rowing configuration 345, the chassis footprint 340 is kept small by mounting the resistance engine 116 and the display 305 as close to the retracted position of the handle 341 as possible. The resistance engine 116 can be mounted within the chassis 312 or in a resistance engine enclosure 347 that is between the rower's feet, but vertically displaced so as not to interfere with the rowing motion. The resistance engine 116 can be mounted so that no portion of the resistance engine is at a distance 342 that is more than four inches, six inches, eight inches, ten inches, or twelve inches in the longitudinal direction from the retracted position of the handle 341 (in the direction away from the rower). The cable connecting the handle to the resistance engine can be routed with pulleys or other friction reducing devices to direct the cable to the resistance engine without the cable projecting in the longitudinal direction more than four inches, six inches, eight inches, ten inches, or twelve inches from the retracted position of the handle 341 (in the direction away from the rower). The length of the chassis 312 on the end that extends away from the retracted position of the handle is determined by the body geometry of the rower when the rower is in a fully extended position at the end of the power phase of a stroke. At this point in a stroke, the slideable seat 300 is in its furthest position from the retracted position of the handle. At this point, the rower's legs are fully or nearly fully extended. Thus a rower with longer legs would need a longer chassis than a rower with shorter legs. The chassis 312 can be configured so that its length 345, and in particular the length of the rail 313, can be adjusted to the minimum length suitable for a rower given his or her maximum seat extension away from the handle 341 in the retracted position.

In some cases, the rowing machine can have a smaller footprint than typical rowing machines. For example, typical rowing machines are about 8 feet long. Part of that length is to accommodate the rower's anatomy, and so cannot be easily decreased. But part of that length is to accommodate the resistance engine that provides resistance to the rower's rowing motion. In some instances, the size of the resistance engine in the rowing machine is more compact than in a typical rowing machine. Also, the resistance engine of the rowing machine can be located in a section of the chassis or rail so as to minimize the length of the rowing machine so that the length is no more than YY inches or in some cases no more than YY-N inches. In some cases, the rowing machine can have a footprint of no more than 16 square feet or 15 square feet or 14.3 square feet when in use, with the footprint being measured by the product of maximum length (length at the longest place) times maximum width (width at the widest place).

In some implementations, the chassis 312 can be configured for storage. In the storage configuration, the chassis 312 can have a footprint that is less than half, less than one third, less than one quarter, or less than one fifth of the footprint when configured for rowing. In the storage configuration, the rail 313 can be in a vertical position, or can be in another non-horizontal position. To provide a small footprint in the storage configuration (e.g., a footprint area of less than 5.5 square feet, such as 5.1 square feet), the chassis 312 and the rail 313 can be foldable with hinges or joints, or they can be detachable into two, three, four, five, or more pieces with quick connects or other mechanical connections that can be detached or connected without use of a tool, or with a simple hand tool such as an Allen key or a screwdriver. In some implementations, to ease tilting the rowing machine from a rowing configuration to a vertical storage configuration, the center of gravity of the rowing machine can be located between the legs 326 near the end of the chassis 319, and the highest point of the chassis when the chassis is configured for rowing.

As discussed above, in some cases, the chassis 312 can be integrated with a rail 313. In some cases, a rail can be a separate structure attached to the chassis 312 or mounted on the chassis 312 at mounting points. The rail 313 can include a longitudinal member that is positioned in a horizontal or near horizontal position when the rowing machine is in the rowing configuration. The rail 313 can be an integral member of the chassis 312. Near horizontal position can include angles up to 20 degrees from horizontal. Angles deviating from horizontal can be desirable for special rowing exercises or training techniques for muscle groups different from traditional rowing motion in a shell on open water.

Figure 17:
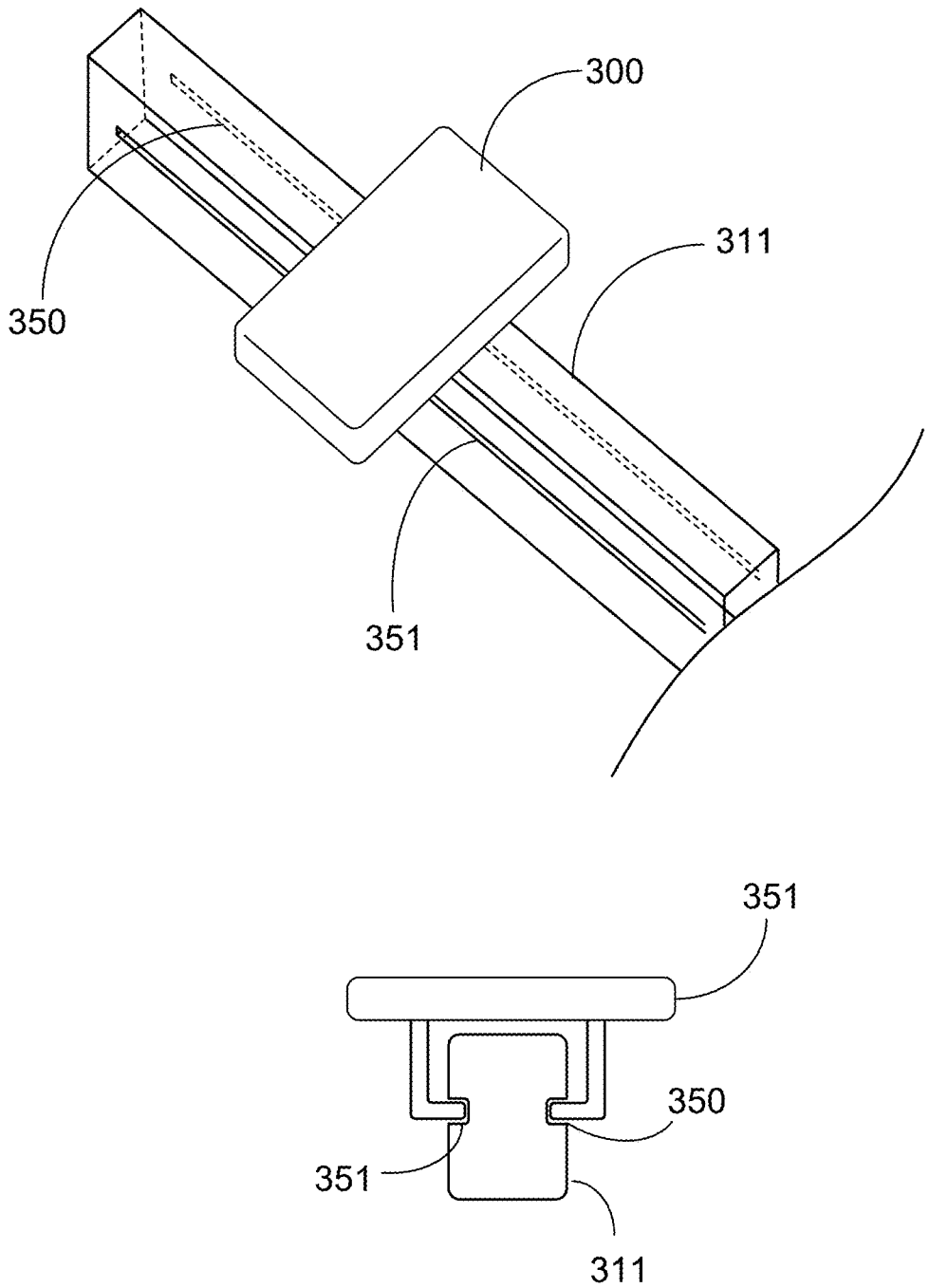
FIG. 17 is a schematic perspective view and a schematic end view of a seat on a rail.

The rail provides a platform for the slidable seat 300 to slide. The rail 313 can provide an exposed engagement surface for the slideable seat 300. In some implementations, as shown in FIG. 17, the rail can also provide an enclosed engagement surface for the slideable seat 120, and one or more longitudinal slots 350, 351 for supporting the exposed portion of the slideable seat. The enclosed engagement surface can be desirable as it minimizes dust, sweat, and other contamination that could impede smooth rolling of the slideable seat 300.

Moreover, to reduce the chance for contamination, the longitudinal slot or slots for supporting the exposed portion of the slideable seat can preferably be positioned along the sides or bottom of the rail rather than at the top of the rail.

In some implementations, the rail 313 can be a split rail, in which two or more parallel rail portions together provide an engagement surface for the seat.

The rail 313 can be made of, for example, wood, stainless steel, steel alloys, aluminum alloys, titanium alloys, plastic, composite plastic, fiberglass reinforced resin materials, carbon fiber composites, and various combinations of these materials. The contact surface between the rail 313 and the slideable seat 300 should be smooth and hard to minimize friction and ensure longevity. The contact surface between the rail 313 and the slideable seat 300 can be lined with a low friction material such as strips of PTFE or HDPE. These low friction plastic surfaces are preferably easily replaceable when worn. To aid friction reduction, the rail material can be compatible with lubricants such as lubricating oils, grease, and powders.

As discussed above, the length of the rail can be adjustable. Adjustability can be achieved by use of a nested section of the rail that can be retracted or extended. Alternatively, one or more length extending plugs can be configured to allow extension of rail length. Different lengths of rail 313 can be offered to rowers.

In some embodiments, one or both ends of the rail 313 can be curved in the vertical direction. For the end closest to the handle in the retracted position, an upward curve of the rail 313 can provide a suitable mounting position for a display 305 or a position for a resistance engine 116. For the end furthest from the retracted position of the handle, an upward curve of the rail 313 can provide a way to keep a rower from shooting the seat backwards improperly or even off the end of the rail during a rowing stroke, or when mounting or dismounting the rowing machine. An end plug or stopper can also be useful at the end of the rail 313 furthest from the handle in the retracted position for preventing the seat from falling off the rail.

In some embodiments, the rail 313 can be configured for mounting one or more sensors for measuring the position, speed, acceleration, and direction of the slideable seat 300 as the rower moves the seat during the rowing motion. The sensors can be mounted externally to the rail or hidden internally within the body of the rail. The rail can be notched, etched, or visually marked with paint or anodization to aid certain sensors to measure the position, speed, acceleration, and direction of the slideable seat 300.

In some implementations, the seat 300 is slideable. The slideable seat 300 can move along a certain portion of the length of the rail as the rower moves through the full motion of a rowing stroke. The slideable seat 300 can include sensors that measure the speed, direction, acceleration, and position of the seat along the rail 313. The seat can also include a sensor to measure the rower's weight.

In some implementations, the slideable seat 300 is configured with wheels, ball bearings, or roller bearings at the contact with the rail. The typical goal is to reduce the friction between the seat and the rail to ensure smooth sliding.

However, for increased load training of the legs, in particular the quadriceps and gluteus muscles, it is desirable to increase the resistance of the seat to sliding. When increased friction or seat sliding resistance is desired, a braking mechanism such as a high friction drum can be mounted on the seat near its contact point with the rail 313, and the braking mechanism can act on the rail 300 to impeded the sliding action of the seat 300. In some cases, the braking mechanism can be adjustable and/or removable so that the lowest friction configuration is comparable in sliding resistance to an on-water racing shell.

In some implementations, the slideable seat 300 can be lockable in a certain position along the length of the rail. This locked-seat configuration can be desirable for isolated upper-body workouts during which the rower pulls on the handle without using leg extension. For example, the locked configuration simulates upper body focused seated row exercise typically performed on a weight machine in a gym. The lockable slideable seat 300 can be unlocked to allow the seat to slide.

In some implementations, the slideable seat 300 can be passively ventilated by a mesh or other breathable material for the contact surface with the rower. The seat 300 can be actively ventilated by having an electrical motor driven fan located underneath the rower's buttock.

The resistance engine 116 provides resistance to the rower's rowing motion. The resistance engine provides resistance to the extension of the handle from its retracted position. In some cases, the amount of the resistance provided to the rower at successive moments in time can be varied over high frequency, such as at 120 Hz, 100 Hz, 80 Hz, 60 Hz, or over short time intervals such as one tenth of a second, 50 milliseconds, 25 milliseconds, 10 milliseconds, one millisecond, or any other time interval between one tenth of a second to one millisecond. In some cases, the resistance engine can be responsive to allow variation in resistance of as much as 20% over 10 milliseconds, 10% over 5 milliseconds, or 2% over one millisecond. The rapid response of the resistance engine to significantly change resistance level over the millisecond time scale allows the resistance engine to provide a resistance profile over time (say over the period of a stroke, or a longer period) that closely simulates the resistance that a rower would feel when rowing on water, as well as to simulate any type of rowing scenario or rowing context, including rowing on a rowing machine of a particular type.

The resistance profile of a rower in a shell on water during a single complete stroke varies throughout the stroke. For example, during the initial power phase in which the shell is accelerating, there is a sharp rise in resistance as the rower accelerates the oar blade to bring up the shell speed. During the middle of the power phase, the shell speed increases steadily and the resistance drops off gradually as the shell speed approaches the blade speed. Near the end of the power phase, as the blade is being lifted from the water, the resistance drops off more rapidly and goes to zero as the blades leaves the water and the rower enters the recovery phase. During the recovery phase, the rower should not experience resistance from the resistance engine 116. Therefore, as an example, to simulate on-water rowing or rowing according to any other scenario or context, the resistance engine 116 can vary its resistance to match the resistance profile experienced by a rower at every stage during all phases of a single stroke and for a series of strokes. The ability of the resistance engine to produce rapidly changing degrees of resistance at a high frequency enables the resistance engine to produce resistance profiles of virtually any kind that might be experienced by a rower in any kind of rowing scenario or context.

In some instances, the electrical power supply for the resistance engine can provide higher current and voltage than power supplies typically used in, for example, bicycle trainer resistance engines. Higher voltage and current could enable more rapid changes of mechanical resistance and higher achievable overall resistance. For some embodiments, the voltage supply for the resistance engine can be 24 volts, 36 volts, 48 volts, 60 volts, 72 volts, 84, volts, 96 volts, or anywhere between those voltages, or up to 120 volts. The commensurate current needed to provide the same mechanical resistance would be lower at higher voltage, and thus thinner wires and windings are needed at higher voltage and would be advantageous.

Figure 18:
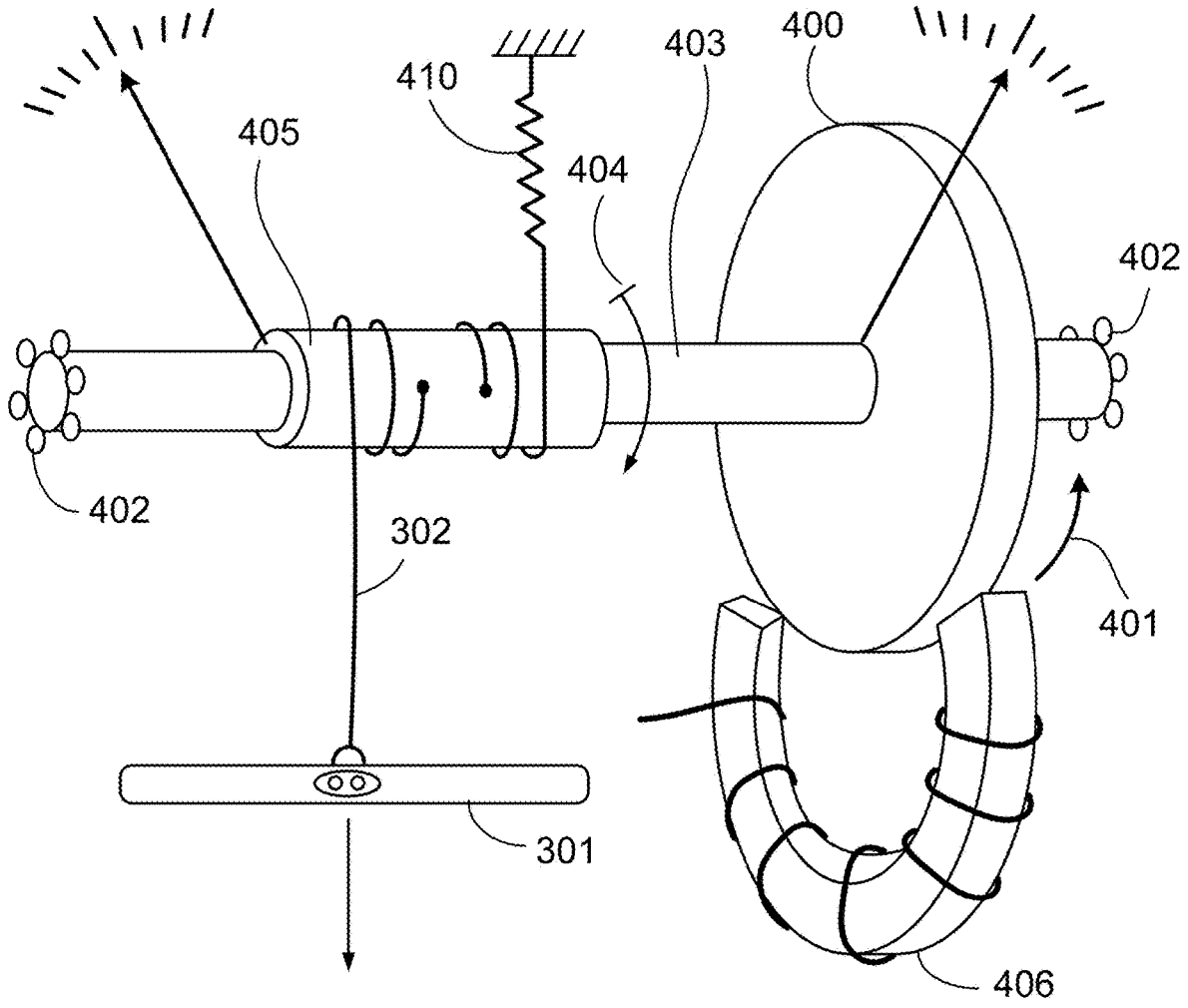
FIGS. 18 through 20 are schematic perspective views of resistance engines.

In some embodiments, an eddy current brake 401 is the source of the mechanical resistance generated by the resistance engine 116. As shown in FIG. 18, the eddy current brake includes a disk. Alternatively, the eddy current brake can be a linear brake. Packaging, cost, and functional considerations affect the selection of a circular versus a linear eddy current brake. Eddy current brakes are quiet during operation, typically no more than 40 decibels when mounted in the rowing machine described here. They are quieter than air fans found on some rowing machines. Rowers of rowing machines are likely to prefer quieter rather than noisier rowing machines.

In some embodiments, the eddy current brake disk comprises a conductive non-ferromagnetic metal disk (rotor) attached to an axle. The axle is driven by the rower as the rower pulls on the handle and the force is transmitted to the axle by the cable. One or more electromagnets 406 can be located with poles on opposite sides of the disk, so that the magnetic fields generated by the electromagnets pass through the disk. Because the magnetic field generated by each electromagnet can be varied electrically, the electromagnet can be controlled electrically to produce a varied the braking force on the disk. When no current is passing through the electromagnet's winding, there is no braking force. When a current is passed through the electromagnet windings, creating a magnetic field, there is a braking force. The higher the current in the winding, the stronger the eddy currents and the stronger the braking force. In some cases, the diameter of the brake disk ranges from 4 inches to 24 inches. In some cases, the thickness of the brake disk ranges from one-quarter inch to 3 inches. The diameter and thickness of the brake disk, along with the material density, determines the rotational inertia of the brake disk. The rotational inertia causes the brake disk to function as a flywheel.

As shown in FIG. 18, the eddy current brake disk 400 rotates about an axle 403. In some embodiments, the axle of the eddy current brake disk is held on one or more sets of bearings 402. In some cases, the bearings can be ball bearings or roller bearings or they can be sealed cartridge bearings that allow relative ease of replacement. The bearing assembly can have dust caps and other seals to prevent contamination. The bearings can be fabricated from steel, ceramic, or other hard materials. The bearings allow the axle to rotate freely with minimal friction.

In some examples, the axle extends axially beyond the rotational axis of the eddy current brake disk and connects to a one-way clutch 404. The one-way clutch can be a roller bearing clutch or a ratchet clutch. An axle 405 on the other side of the one-way clutch can be connected to the cable 302 that is connected to the handle 301. The cable can be spooled around a spool that rotates about the axle. The axles on the two sides of the clutch can share a common axis of rotation. The cable and spool are described further below. The one-way clutch connects or engages the axles—the one with the eddy current brake disk and the one with the cable spool—when the axle with the cable spool is being driven at a higher angular velocity than the axle with the eddy current brake disk. The engagement can occur during the power phase of a rowing stroke, i.e. when the rower is pulling on the handle. When the clutch is engaged, the rower feels a resistance from the eddy current brake. The one way clutch disconnects or disengages the axles when the axle with the cable spool has a lower angular velocity than the axle with the eddy current brake disk. The disengagement can occur during the recovery phase of a rowing stroke, i.e. when the handle is being returned to its retracted position. When the clutch is disengaged, the rower does not feel a resistance from the eddy current brake.

Figure 19:
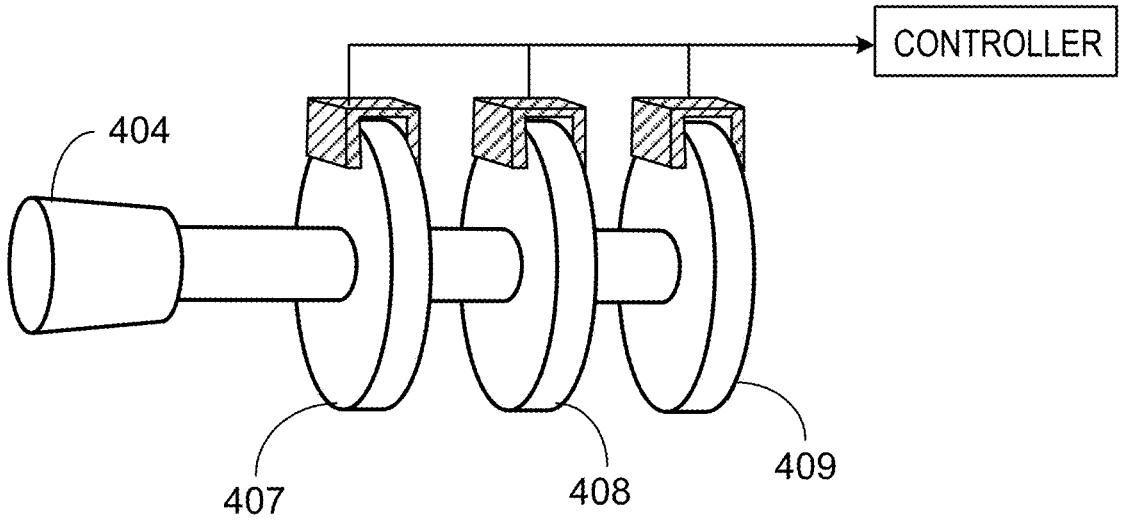

As shown in FIG. 19, in some embodiments, two or more eddy current brake disks 407, 408, 409 can be used in tandem to provide the resistance of the resistance engine. The two or more eddy current brakes can share a rotational axis and share an axle 404. Alternatively, they can have different rotational axes and axles, while each provides resistance to the extension of the cable that the rower pulls. By using more than one disk eddy current brake, the diameter, thickness, and mass of each eddy current brake disk can be smaller. Smaller and lighter eddy current brake disks can be desirable, particularly for packaging reasons.

Figure 20:
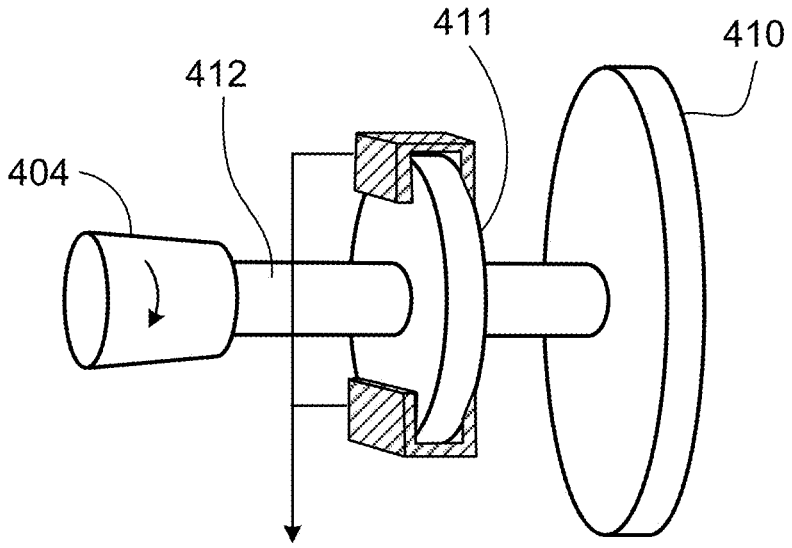

In some embodiments, the eddy current brake disk can simultaneously provide the function of a flywheel with sufficient rotational inertia to approximate the recovery phase of the resistance profile of rowing on water or another desired resistance profile scenario. As shown in FIG. 20, when a resistance profile requiring more rotational inertia is desired, a flywheel for 10 can be coupled to the eddy current brake disk for 11 to provide additional rotational inertia. The flywheel can share the same axle 412 as the disk eddy current brake. The flywheel can alternatively have a different axis of rotation from the disk eddy current brake, so long as it acts on the axle to which the eddy current brake disk is connected, such as by use of gear, chains, or other force transfer devices. The flywheel can act in concert with the eddy current brake disk to provide additional rotational inertia. The diameter of the flywheel can range from 4 inches to 24 inches. The thickness of the flywheel can range from one-quarter inch to 3 inches. The diameter and thickness of the flywheel, along with the material density, dictates the rotational inertia of the flywheel.

In some cases, two or more flywheels can be used in tandem to provide additional rotational inertia. The two or more flywheels can share a rotational axis and share an axle. Alternatively, they can have different rotational axes and axles, but they each provides rotational inertia to the extension of the cable that the rower pulls. By using more than one flywheel, the diameter, thickness, and mass of each eddy current brake disk can be smaller. Smaller and lighter flywheels can be desirable, particularly for packaging reasons.

In some instances, the resistance of the resistance engine 116 can be provided by a motor-generator.

We use the term "motor generator" broadly to include, for example, any power transducer that can convert in either direction between electrical power and mechanical power, such as an electromechanical device that can serve as either an electric motor or a generator. In some examples, the magnetic field strength of a generator-motor can be varied to vary the mechanical resistance supplied by motor-generator at an output shaft.

The electrical energy generated by a rower's rowing motion rotating the motor-generator axle can be stored in a capacitor or battery. The stored energy can be used to run a controller or participation device or supplement the power demand of the rowing machine.

In some instances, a combination of an eddy current brake and a motor-generator can provide resistance in combination. The eddy current brake and the motor-generator could share a single rotor axle, or could act on a single axle by use of gears, chains, or other means of power transmission. The combination of two different resistance generating devices could enable fine tuning of the resistance profile provided by the resistance engine.

In some embodiments, the resistance engine has sensors that measure the angular velocity of the disk eddy current brake, the fly wheel, or the motor-generator. In a resistance engine having two or more of the disk eddy current brakes, the fly wheel, or the motor-generator, the angular velocity of each component can be the same if they share the same axle, or if on different axles, they are mechanically coupled by zero reduction ratio gearing mechanisms. Using the eddy current brake disk as an example, the resistance provided by the eddy current brake disk (i.e. the torque needed to turn the disk at a given rotation rate) increases linearly with the rotational speed of the disk at a given magnetic field strength. To more closely simulate the experience of rowing in a shell on water, the resistance provided by the eddy current brake disk should increase at least as the square of the rotational speed. In order to provide this non-linear increase in resistance, the magnetic field strength must be increased as the rotational rate of the disk increases. The magnetic field strength of the electromagnets can be increased by increasing the current. For a given voltage supply, this can be achieved using a rheostat. The magnetic field strength of the electromagnets can also be increased by moving the poles of the magnet closer together. This can be achieved by mounting the magnets on movable supports on a servo motor.

Figure 21:
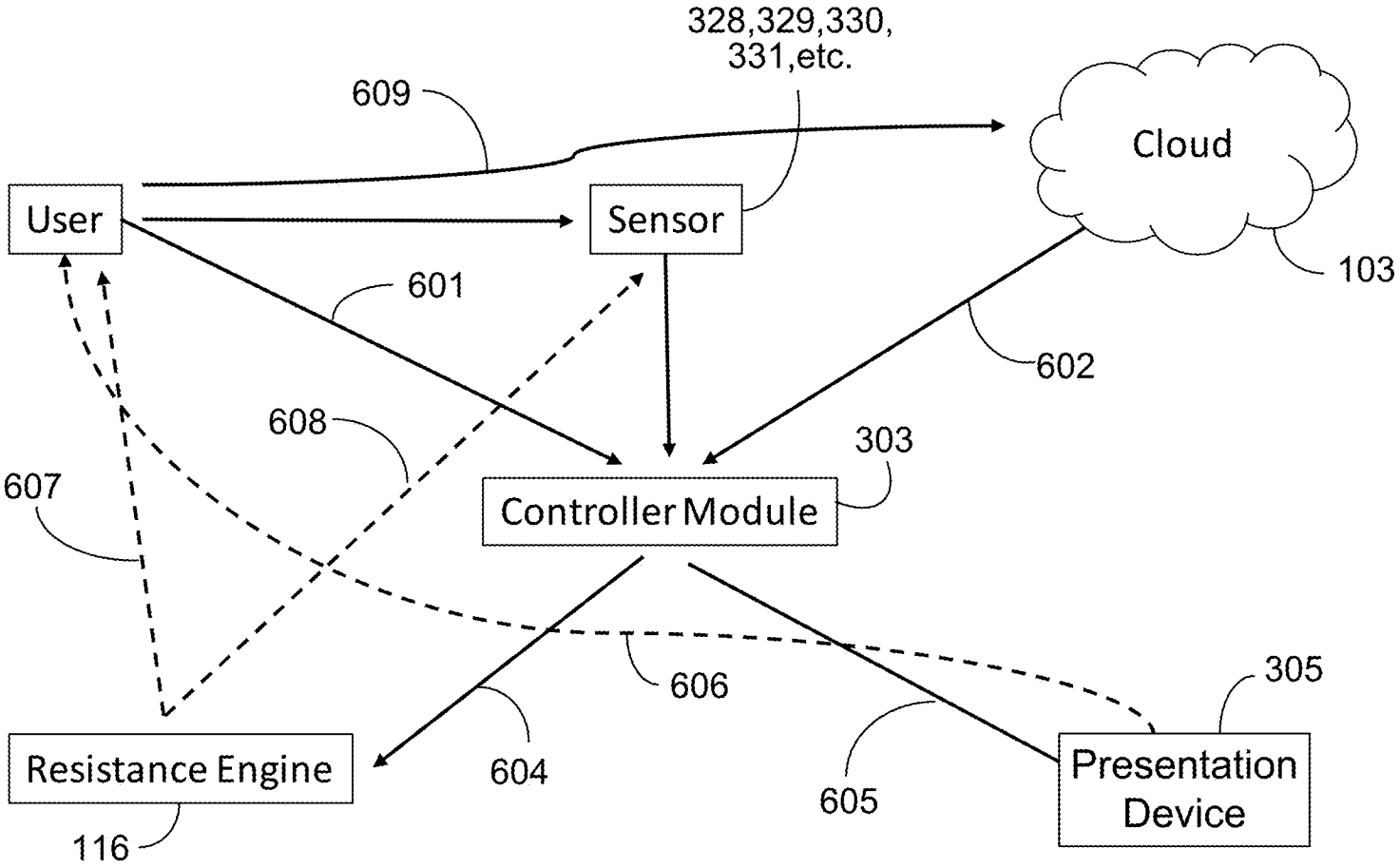

As shown in FIG. 21, in some examples, the resistance engine 116 includes a rheostat or other device for rapidly changing the current supplied or drawn from the eddy current brake disk or the motor-generator. The resistance engine includes an electrical interface or connectors for receiving input 604 from a controller 303 for controlling the resistance engine's output. The input from the controller can be received through a hard-wired connector or a wireless connection.

In some embodiments, the resistance engine can be instrumented by sensors 328, 329, 330, 331 for measuring the torque experienced by the flywheel. The torque measuring sensor can be one or more strain gauges. For high resolution and high accuracy torque measurements, four to eight strain gauges are used. For lower resolution and accuracy torque measurements, one to four strain gauges can be used.

In some embodiments, the eddy current brake disk, the flywheel, or the motor-generator can be cooled by airflow directed by one or more electric fans. One or more electric fans can be located near the disk eddy current brake. In some cases, one of more electric fans can be located remotely from the disk eddy current brake, with the cooling air flow directed with air ducts or directed by hollow chassis members such as an enclosed rail functioning as an air conduit. The enclosure of the resistance engine can have air intake vents or mesh sections. The chassis members can also have ventilation openings to aid the cooling of the disk eddy current brake. Continuous high intensity use of the eddy current brake disk and the motor-generator can generate sufficient heat to cause malfunction. The eddy current brake disk and the motor-generator have operating temperature limits and can malfunction and have shorter service life if overheated. The resistance provided by an eddy current brake disk and a motor-generator can vary according to temperature. It would be desirable to keep track of the operating temperature of the eddy current brake disk and the motor-generator and maintain the devices within an optimal temperature range. The controller for the resistance engine, as described further below, would take into account disk and magnet temperature 603, for example, and adjust the current to the electromagnet accordingly. A temperature sensor can provide the controller with this temperature information. The controller can also use this temperature information to adjust the intensity of the cooling airflow to maintain the resistance engine at an optimal temperature.

In some instances, the eddy current brake disk can provide up to 3,000 watts of peak resistance, and at least 800 watts of continuous resistance. The cooling system is capable of maintaining acceptable operating temperature for eddy current brake disk when the brake is operating continuously at 750 watts of resistance.

In some embodiments, the rowing machine has at least one sensor to measure the angular velocity of one or more of the disk eddy current brake, flywheel, and motor-generator. A temperature sensor can be included to track the temperature of at least one of the eddy current brake disk and the motor-generator. In some cases, the rowing machine can have other sensors to provide input to the controller or to provide rowing performance data to the server or to the rower or both. The types of sensors include load cells, Hall effect sensors, optical sensors, and electrodes. Other types of sensors useful for measuring force, deformation, weight, position, speed, and other physical and human performance parameters can also be used. One or more sensors can be located on the rail or the seat to measure seat travel direction, speed, acceleration and rower weight. One or more sensors can be located on the handle to measure applied force, position, speed, acceleration, heart rate, or travel direction. One or more sensors can be located on the footrest to measure the contribution of the legs to the power stroke.

In some embodiments, rowing performance data or metrics can be calculated or processed based on sensor data including one or more of: 500 meter time split, power (watts), stroke rate (stroke per minute), count down timer, total meters rowed, average split, stroke length (meters), stroke duration (seconds), calories burned, heart rate (via ANT, ANT+, or other wireless heart rate monitor protocols), power curve, drag factor (read only), or drive time (seconds). The controller or the participation device or both receives data from one or more of the sensors and can calculate rowing performance data from the sensor data. Alternatively, the data from the sensors can be transmitted by the communications portion of the controller or participation device to a local mobile device or to the rowing server for processing to provide rower readable performance data and metrics.

In some embodiments, the rower can use a heart rate monitor, though not attached to the rowing machine itself, to sense the rower's heart rate. The display system is configured to receive the heart rate data and display it on the screen. The rower's heart rate data can also be transmitted to a server for storage in the database as part of the rower's performance profile that is associated with the resistance profile.

In some implementations, the handle is connected by a cable to a spool or sprocket that turns on an axle with resistance provided by the resistance engine. In some cases, the handle is a capable of transmitting repeated 1000 N forces to the cable. The handle can be made from wood, metal, plastic or other materials, and be covered with an absorbent grip material for enhanced comfort and grip. The handle can be approximately the shape and size of a handle of an oar. The handle can be an ergonomic shape that allows a rower to grab onto it and exert 1000 N of tensile force in the direction away from the retracted handle position, without slippage and without discomfort.

The handle can have embedded sensors for measuring the force applied by the rower. From this force data, power can be calculated. In some cases, the handle can have position sensors that measure position of the handle relative to the rail and the catch position. Position data of the handle can be used to help coach the rower to improve rowing form. In some cases, the handle can have embedded electrodes that allow measurement of the rower's heart rate through the rower's hand contact. The handle can, for example, be split into two halves and connected by two cables to a Y to simulate sculling, which uses two oars. In some implementations, the handle can include a built-in ratchet to simulate feathering of the oar when rowing on water.

In some embodiments, the handle can have a built-in rower interface which serves as or is part of a participation device, for controlling the rowing experience, among other things. The handle can have one or more buttons, switches, or touch-control surfaces for the rower to toggle among display settings. For example, the rower can choose to display on a screen of a participation device, different rowing performance data fields while rowing. In some cases, the rower many choose to decrease resistance of the resistance engine in the middle of a rowing session. By having a rower interface on the handle, the rower can make changes to the rowing experience while rowing, such as by changing the rowing scenario or rowing context or a wide variety of other parameters without interrupting the rowing session.

We use the term "cable" broadly to include, for example, any entity for transmitting tensile force from the handle to the resistance engine. The cable can be a cable, such as a braided steel cable. The cable can be a rope, a cord, a belt, a toothed belt, a v-belt, or webbing, or combinations of them. The cable can also be a chain with links. The cable must be able to deform less than 5% under a tensile load of 1000 N. The cable should be essentially unable to transmit compressive force. The cable should be able to wrap around wheels (such as pulley wheels, or sprockets in case the cable is a chain) to change the direction of the transmitted force. The cable should relatively easy to replace.

In some embodiments, the end of the cable opposite the handle is connected to a return mechanism for returning the handle to its retracted position after the rower has pulled the handle during the power phase of the rowing stroke. In some cases, the return mechanism can be a spring or elastic cord that is attached to the spool and is extended from its relaxed position as the cable is pulled by the rower. The spring or elastic cord mechanism can be fixed on one end to the chassis or rail, and connected on the other end to the cable by one or more pulleys or sliding mechanisms. In some instances, between the handle and the return mechanism, the cable is engaged with a wheel or sprocket that turns on an axle with resistance provided by the resistance engine. When the cable is a cable, rope, or cord, the spool (e.g., a reel) must impose friction between the cable and the wheel that turns on an axle with resistance provided by the resistance engine. When the cable is a chain, a sprocket is attached to the axle with resistance provided by the resistance engine, providing slip-free transmission of resistance between the handle and the resistance engine.

In some implementations, the return mechanism includes a spool that rotates about the axis that transmits resistance from the resistance engine. The cable winds around the spool. A spring inside the spool is set to be at its relaxed position when the handle is in its retracted position. When the rower pulls on the handle, the spring loads and the spooler rotates to pull on the cable and returns the handle to its retracted position.

In lieu of or in addition to the spring in the spool, an electric motor or a motor generator can drive the cable towards the retracted position, in a direction opposite from the rowing power stroke. In this design, the electric motor or motor-generator can serve the dual function of both providing resistance and retracting the cable during the recovery phase of the rowing stroke.

In some embodiments, the rowing machine includes a participation device that serves as a presentation device 305 having, among other things, video and audio presentation capability. In some cases, the rowing machine includes an adjustable or tiltable presentation device dock configured to receive a rower supplied presentation device having a display screen and audio capability, such as a tablet computer or a smart phone. In some cases, the presentation device dock can be adjusted for height and reach. In some cases, the presentation device can include a touchscreen that also serves as a rower interface feature of a participation device. The presentation device screen is sized so that a rower on the rowing machine with normal vision can comfortably read rowing performance data displayed on the screen when in the fully extended position. The display of the presentation device is at least 4 inches diagonal. The display of the presentation device is typically 20 inches diagonal or larger. The video and audio capabilities can sometimes be provided by a virtual reality headset.

In some cases, a screen of the presentation device displays information 605 from the controller, such as rowing performance data provided from the various sensors (or calculated from raw data provided by the sensors) on the rowing machine. The presentation device also can present heart rate information from the rower. The screen can display video clips from locally stored sources such as pre-recorded video clips of a rower rowing on water or a rower rowing on a rowing machine. The screen can display video from remote sources (including the server) such as pre-recorded video or live-video of a rower rowing on water or a rower rowing on a rowing machine.

The rowing machine can include participation devices such as video cameras and microphones for recording the rowing motions and voice of the rower. A video camera can be located in front of the rower, pointing at the rower to record the rower's face and rowing motion. A video camera can be located behind the rower near the end of the chassis or rail to record the rower's rowing motion from behind. The video camera can be located at a distance from the rowing machine and the rower, such as for example on a tripod or a piece of furniture, to capture a side, front, rear, or perspective view of the rower and the rower's rowing motion. The distant camera can communicate with the participation device of the rowing machine. The captured video clip or audio data file can be temporally synchronized with accompanying performance data from the rowing machine when available, so that the playback speed of the video clip or audio data file can be adjusted to correspond to the stroke motion of the rower.

An electronic controller 303 (which we sometimes call simply a "controller" and which sometimes serves more broadly as a participation device; we sometimes use the terms "controller" and "participation device" interchangeably in this context) can include a processor that controls the resistance provided by the eddy current brake 116 (and the motor-generator if one is present). The controller or another participation device can have other functions described above and below.

In some cases, the controller or the participation device can be a general purpose computer, such as laptop computer, a desktop computer, a tablet, or a smart phone. The participation device can be a dedicated computer having a logic circuit, a memory circuit, and non-volatile storage. The participation device can have hardwire connections to the resistance engine, sensors, display, control interface, and other components of the rowing machine. The participation device can have a wireless connection (e.g. WiFi, Bluetooth, ANT, ANT+, HaLow, BLE, and other wireless or near-field wireless communication protocols) for sending and receiving data to and from the resistance engine, sensors, display, control interface, and other components of the rowing machine. The participation device can be able to access the Internet to access servers that store rower data, rowing session profiles, and other data that can be used to control the resistance engine.

Figure 22:
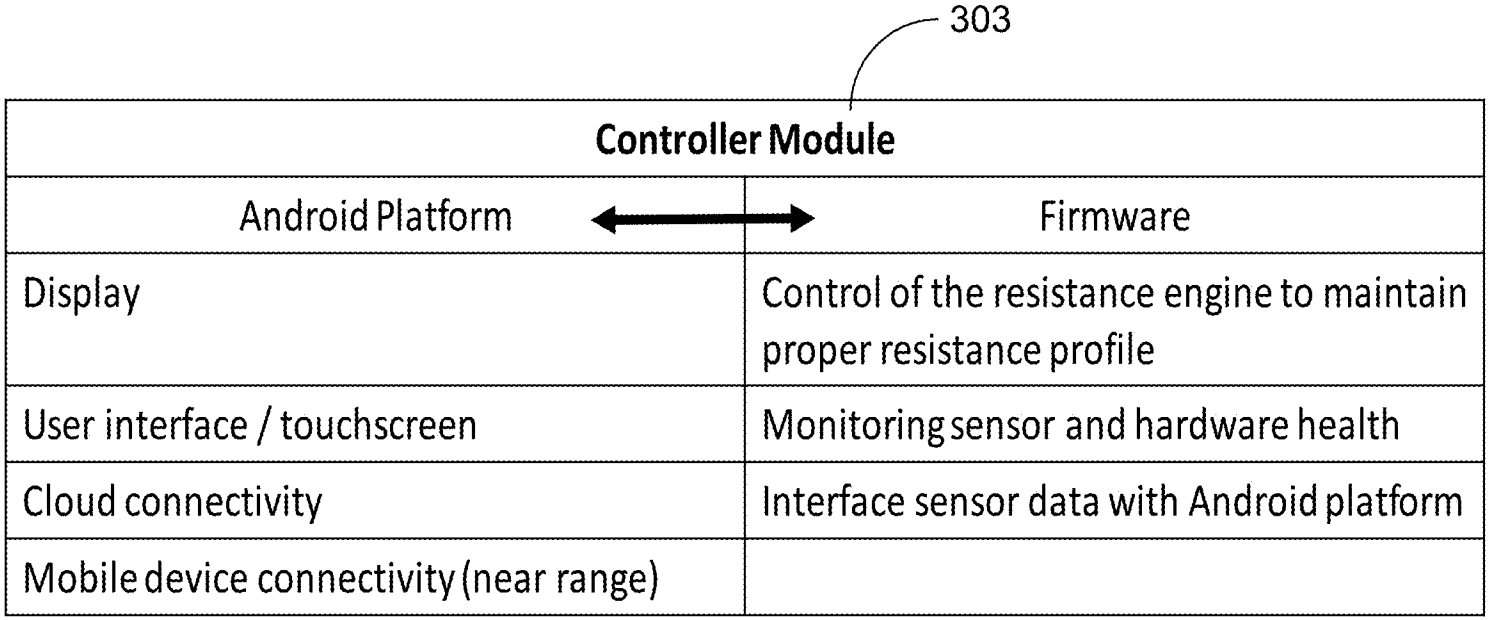
FIG. 22 is a table.

In some embodiments, the participation device performs the functions of two devices. As shown also in FIG. 22, one part, the controller 303, running a non-proprietary operating system such as Android, can run an application for controlling communications with the rowing server, communications with wireless accessories (heart rate monitor, remote cameras, remote microphones, for example), for providing rower interface controls, and for controlling and processing data for the display. Another part of the participation device, running on proprietary firmware and algorithms, can interface with the sensors and the resistance engine, and provide means for checking the status and health of the hardware components on the rowing machine.

In some embodiments, the participation device receives input 603 from the sensors on the rowing machine and the rower (e.g., heart rate data), the rower input parameters, locally stored data, and data from a server. The sensor inputs include angular velocity data from the disk eddy current brake, the flywheel, or the motor-generator. The sensor inputs can provide a temperature of the eddy current brake disk or the motor-generator. The sensor inputs can include torque measurements of the eddy current brake disk or the motor-generator. The sensor inputs can include other data from other sensors as described below. Based on sensor data, the logic circuit in the controller calculates a current necessary to provide a particular resistance by the eddy current brake disk or the motor-generator.

In some embodiments, the participation device receives input parameters from the rower through one or more control interfaces such as touch screen, keyboard, mouse, or microphone with voice recognition capability. The rower can, for example, provide body weight, gender, age, shell type (single, double, four, eight, coxed, coxless, extra resistance, scull, other types of shells), oar designs, oar numbers, shell weight (with or without coxswain), rigging design, shell size, weight, gender, age of other crew members in a multi-person shell, water current, or other factors that affect or could affect the resistance experienced by a rower rowing on water or could affect the resistance in other rowing contexts and rowing scenarios. Based on rower input parameters, the logic circuit in the controller calculates an electrical current necessary for the eddy current brake disk or the motor-generator to provide a particular resistance at each moment.

For example, in a shell on water, heavier rowers experience more drag as the shell sits lower in the water. The participation device would factor in body weight when calculating an electrical current for the resistance engine, with a heavier rower experiencing more resistance relative to a lighter rower, all else being equal. The rower can also, for example, select a rowing context that simulates interval exercise in which resistance is periodically increased. For example, the rower can select increased resistance for sixty seconds followed by reduced resistance for thirty seconds. The participation device would receive such rower input to adjust the resistance (or resistance profile) of the resistance engine. As yet another example, rowers sometimes attach bungee cords or ropes to the bow of the shell below the waterline to increase drag for training purposes. The rower can select the option to simulate having a bungee cord attached to the bow of the shell. The participation device would receive the rower command and increase the resistance to simulate having a bungee cord on the bow of the bow.

In some embodiments, the participation device can receive input from a locally stored data source. The local data source can be a hard drive, a memory stick, a solid-state drive, or another form of non-volatile memory. The locally stored data can be rower input parameters, as described previously, that has been stored locally. The locally stored data can also be data downloaded from a server, such as from a website. The locally stored data can further include resistance profiles of entire rowing experiences. For example, the locally stored data can be a 30 minute resistance profile of a rowing session on the Charles River. By storing data locally, no internet connection is necessary to provide certain functionalities of the rowing machine. The controller can vary the resistance of the eddy current brake disk based in part on the locally stored data.

In some embodiments, the controller can receive input from a remote data source. The remote data source can be a server or rowing server, such as a cloud service site on Amazon Web Services, that is accessible via the internet. The remote data source can be another rowing machine or shell on water having wireless communication capability. The remote data can be pre-recorded resistance profiles or pre-recorded performance data of the rower from a prior session on the rowing machine or in a shell on water, or live (real-time) or pre-recorded (archived, stored) resistance profile or performance data of another rower on a rowing machine or in a shell on water. The remotely stored data can also be rower input parameters, as described previously, that has been stored remotely. The remotely stored data can include resistance profiles of entire rowing experiences. The controller can vary the resistance of the eddy current brake disk based in part on the remote data.

In some embodiments, the participation device controls the video or audio presented to the rower. The participation device presents the video or audio on command from the rower. For example, the rower can request a pre-recorded rowing session that have a particular scenery of rowing on water.

In some embodiments, the participation device can synchronize the video-playback with the stroke motion of the rower and the resistance provided by the resistance engine. Synchronization is useful so that the rower's motions are timed consistently with the rower's visual feedback. For example, when the rower is in the power phase of a stroke, the video should also display a rower in the power phase of a stroke. The rower in the video can be rowing at 30 strokes per minute, but the rower on the rowing machine is only rowing at 24 strokes per minute. The participation device can slow the frame rate of the video so that the video appears to show a stroke rate of 24 strokes per minute. The participation device can simultaneously vary the resistance profile provided by the resistance engine commensurate with a stroke rate of 24 strokes per minute. When the stroke rate in the video is significantly faster than the stroke rate of the rower, the participation device can generate graphical simulations to fill in the frame gaps to smooth out the video.

In some embodiments, the participation device can be programmed to generate coaching and training advice, and to generate a virtual image of a coach on a skiff traveling on water alongside the shell on water. The coaching and training advice can include instructions to speed up and slow down the stroke rate, instructions on improving stroke form, and instructions to follow another rower, real or virtual.

In some embodiments, the participation device can be programmed to generate images of ghost rowers, ghost shells, ghost coxswain, virtual scenery, and virtual images of oars and oar blade as they enter and exit the water, to create a virtual reality effect of rowing with real oars on water. The ghost rowers can be a pre-recorded prior session of the rower, or can be a computer generated image of the rower whose rowing performance data is pre-recorded from a prior rowing session. Likewise, the ghost shells, coxswain, scenery, can all be computer generated images.

In some embodiments, the participation device can generate graphical overlays for the video display. For example, the participation device can overlay rowing performance data such as stroke rate, stroke length, power, heart rate, distance covered, distance remaining, or time elapsed, on a video of a shell being rowed on water. In some cases, the participation device can overlay images of ghost rowers, ghost shells, ghost coxswain, or ghost coach on a video of a shell being rowed on water. This type of overlay would be particularly useful when the rower is simulating rowing in a multi-person shell, in a race, or in training class with a coach. The participation device can also overlay images of oars and oar blade as they enter and exit the water, to create a virtual reality effect of rowing with real oars on water.

Other implementations are also within the scope of the following claims.

The invention claimed is:

1. A method for providing a social rowing experience, the method comprising:

collecting a first data stream representing motion of each stroke of a first series of strokes from a first rower of a group of two or more rowers, each rower of the two or more rowers rowing on a rowing machine or in a shell on water;

collecting a second data stream representing motion of each stroke of a second series of strokes from a second rower of the group;

processing the first data stream to generate a first display stream and communicating the first display stream to a presentation device of the second rower;

presenting, on the presentation device of the second rower, a rower interface configured to be used to select a first display configuration for the first display stream;

adjusting a playback speed of a video included in the first display stream in order to match the video to the motion of each stroke of the first series of strokes;

processing the second data stream to generate a second display stream and communicating the second display stream to a presentation device of the first rower; and presenting, on the presentation device of the first rower, a rower interface configured to be used to select a second display configuration for the second display stream.

2. The method of claim 1, wherein the first display configuration comprises one of a plurality of different origins of perspectives of the video, the plurality of different origins selectable using the rower interface presented on the presentation device of the second rower.

3. The method of claim 2, wherein the plurality of different origins of perspectives comprise:

two or more different origins located at different positions on a virtual shell, and a third origin located external to the virtual shell, the third origin corresponding to a perspective that includes the virtual shell.

4. The method of claim 1, wherein the first display configuration comprises a plurality of different location contexts for the video, the plurality of different location contexts selectable using the rower interface presented on the presentation device of the second rower.

5. The method of claim 4, wherein the plurality of different location contexts comprise two or more different water bodies to be portrayed in the video.

6. The method of claim 1, wherein the display configuration comprises one of a plurality of different weather contexts, time contexts, or both weather and time contexts for the video, the plurality of different weather contexts, time contexts, or both weather and time contexts selectable using the rower interface presented on the presentation device of the second rower.

7. The method of claim 6, wherein the plurality of different weather contexts, time contexts, or both weather and time contexts comprise at least one of a plurality of weather conditions to be portrayed in the video or a plurality of times of year to be portrayed in the video.

8. The method of claim 1, comprising adjusting a frame rate of the video in order to match the video to the motion of each stroke of the first series of strokes.

9. The method of claim 1, comprising generating graphical simulations that fill frame gaps in the video in order to match the video to the motion of each stroke of the first series of strokes.

10. The method of claim 1, comprising synthesizing the video combining, as a composite video, a foreground video component with a background video component.

11. The method of claim 1, comprising presenting, on the presentation device of the second rower, rowing performance metrics contained in the first data stream.

12. The method of claim 1 comprising adjusting a resistance of each stroke of the second series of strokes, on a rowing machine of the second rower, to correspond with rowing performance metrics contained in the first data stream.

13. The method of claim 1 comprising providing audio, visual, or audio-visual cues to the second rower to correspond with rowing performance metrics contained in the first data stream.

14. The method of claim 13 in which the rowing performance metrics comprise power or torque measurements.

15. The method of claim 13 in which the rowing performance metrics comprise stroke rate, stroke length, or shell speed.

16. The method of claim 1, comprising:

transmitting the first data stream from a rowing machine or shell of the first rower to a server; and transmitting the second data stream from a rowing machine or shell of the second rower to the server.

17. The method of claim 1 comprising:

transmitting the first data stream to the presentation device of the second rower from a server; and transmitting the second data stream to the presentation device of the first rower from the server.

18. A system comprising:

two or more rowing machines, shells on water, or rowing machines and shells on water, each rowing machine or shell on water corresponding to a respective rower of a group of two or more rowers;

a server remote to the two or more rowing machines, shells on water, or rowing machines and shells on water; and a plurality of computing devices distributed among the server and the two or more rowing machines, shells on water, or rowing machines and shells on water, the plurality of computing devices configured to together perform operations comprising:

collecting a first data stream representing motion of each stroke of a first series of strokes from a first rower of the group of two or more rowers;

collecting a second data stream representing motion of each stroke of a second series of strokes from a second rower of the group of two or more rowers;

processing the first data stream to generate a first display stream and communicating the first display stream to a presentation device of the second rower;

presenting, on the presentation device of the second rower, a rower interface configured to be used to select a first display configuration for the first display stream;

adjusting a frame rate of a video included in the first display stream in order to match the video to the motion of each stroke of the first series of strokes;

processing the second data stream to generate a second display stream and communicating the second display stream to a presentation device of the first rower; and presenting, on the presentation device of the first rower, a rower interface configured to be used to select a second display configuration for the second display stream.

19. The system of claim 18, wherein the first display configuration comprises one of a plurality of different origins of perspectives of the video, the plurality of different origins selectable using the rower interface presented on the presentation device of the second rower.

20. The system of claim 18, wherein the operations comprise adjusting a playback speed of the video in order to match the video to the motion of each stroke of the first series of strokes.

21. The system of claim 18, wherein the operations comprise adjusting a resistance of each stroke of the second series of strokes, on a rowing machine of the second rower, to correspond with rowing performance metrics contained in the first data stream.

22. The system of claim 18, wherein the operations comprise providing audio, visual, or audio-visual cues to the second rower to correspond with rowing performance metrics contained in the first data stream.

23. A method for providing a social rowing experience, the method comprising:

collecting a first data stream representing motion of each stroke of a first series of strokes from a first rower of a group of two or more rowers, each rower of the two or more rowers rowing on a rowing machine or in a shell on water;

collecting a second data stream representing motion of each stroke of a second series of strokes from a second rower of the group;

processing the first data stream to generate a first display stream and communicating the first display stream to a presentation device of the second rower;

generating graphical simulations that fill frame gaps in a video included in the first display stream in order to match the video to the motion of each stroke of the first series of strokes;

presenting, on the presentation device of the second rower, a rower interface configured to be used to select a first display configuration for the first display stream;

processing the second data stream to generate a second display stream and communicating the second display stream to a presentation device of the first rower; and presenting, on the presentation device of the first rower, a rower interface configured to be used to select a second display configuration for the second display stream.

* * * * *